US011293143B2

(12) United States Patent
Hamers et al.

(10) Patent No.: US 11,293,143 B2
(45) Date of Patent: Apr. 5, 2022

(54) METHOD FOR PRODUCING SINGLE-LAYER OR MULTI-LAYER PAPER

(71) Applicant: SOLENIS TECHNOLOGIES CAYMAN, L.P., George Town (KY)

(72) Inventors: Christoph Hamers, Ludwigshafen (DE); Anton Esser, Ludwigshafen (DE); Frans De Bruyn, Bad Duerkheim (DE); Christopher Alan Gray, Ludwigshafen (DE); Ralph Isermann, Ludwigshafen (DE)

(73) Assignee: Solenis Technologies, L.P., Wilmington, DE (US)

( * ) Notice: Subject to any disclaimer, the term of this patent is extended or adjusted under 35 U.S.C. 154(b) by 0 days.

(21) Appl. No.: 16/757,525

(22) PCT Filed: Oct. 10, 2018

(86) PCT No.: PCT/EP2018/077623
§ 371 (c)(1),
(2) Date: Apr. 20, 2020

(87) PCT Pub. No.: WO2019/076703
PCT Pub. Date: Apr. 25, 2019

(65) Prior Publication Data

US 2021/0189658 A1 Jun. 24, 2021

(30) Foreign Application Priority Data

Oct. 18, 2017 (EP) ..... 17197011

(51) Int. Cl.

| | |
|---|---|
| ***D21H 21/20*** | (2006.01) |
| ***D21F 11/04*** | (2006.01) |
| ***D21H 17/34*** | (2006.01) |
| ***D21H 17/37*** | (2006.01) |
| ***D21H 23/50*** | (2006.01) |
| ***D21H 27/30*** | (2006.01) |

(52) U.S. Cl.
CPC ..... *D21H 21/20* (2013.01); *D21F 11/04* (2013.01); *D21H 17/34* (2013.01); *D21H 17/37* (2013.01); *D21H 23/50* (2013.01); *D21H 27/30* (2013.01)

(58) Field of Classification Search
USPC ..... 162/127
See application file for complete search history.

(56) References Cited

U.S. PATENT DOCUMENTS

| | | | | |
|---|---|---|---|---|
| 5,630,907 | A * | 5/1997 | Nilz | C08F 8/12 162/168.1 |
| 6,706,145 | B2 * | 3/2004 | Werres | C09J 101/26 162/124 |
| 2003/0155071 | A1 * | 8/2003 | Werres | C09J 129/04 156/307.3 |
| 2011/0079365 | A1 | 4/2011 | Haehnle et al. | |

FOREIGN PATENT DOCUMENTS

| | | | |
|---|---|---|---|
| CN | 1320144 | A | 10/2001 |
| CN | 102076910 | A | 5/2011 |
| DE | 4241117 | A1 | 6/1994 |
| EP | 1378603 | * | 1/2004 |
| JP | 2007063682 | A | 3/2007 |

OTHER PUBLICATIONS

EP 1378603, Aust et al., Jan. 2004, machine translation.*
ISA-EPO, International Search Report and Written Opinion issued in International Application No. PCT/EP2018/077623, dated Nov. 12, 2018.

* cited by examiner

*Primary Examiner* — Mark Halpern
(74) *Attorney, Agent, or Firm* — Lorenz & Kopf, LLP

(57) ABSTRACT

A method to produce dried single-layer or multi-layer paper is disclosed. The method comprises, for a single-layer paper, preparing and spraying a partially dehydrated first fibrous web with a spray solution or suspension to give a sprayed partially dehydrated first fibrous web, and dehydrating the sprayed partially dehydrated first fibrous web by applying heat to form a dried single-layer paper; or, for a multi-layer paper, preparing and spraying a partially dehydrated layer compound with a spray solution or suspension to form a sprayed layer compound, and dehydrating the sprayed layer compound by applying heat to form a dried multi-layer paper. The spray solution or suspension comprises water and at least one water-soluble polymer P, which is obtained by polymerizing: (i) a monomer of formula $H_2CCHNHC(0)R^1$, where $R^1$ is H or $C_1$-$C_6$- alkyl; and (ii) one or more ethylenically unsaturated monomers different from monomer (i).

19 Claims, No Drawings

METHOD FOR PRODUCING SINGLE-LAYER OR MULTI-LAYER PAPER

This application is a 371 of PCT/EP2018/077623 filed 10 Oct. 2017

The invention relates to a method for producing single-layer or multi-layer paper. In case of single-layer paper, the method comprises of dehydrating an aqueous fibrous suspension to obtain a fibrous web, dehydrating the fibrous web by pressing a partially dehydrated fibrous web, spraying the partially dehydrated fibrous web on at least one surface side with an aqueous spray solution or spray suspension to form a sprayed fibrous web and dehydrating the sprayed, partially dehydrated fibrous web to a single-layer paper using heat, the aqueous spray solution or spray suspension containing a water-soluble polymer P. In case of multi-layer paper, the method comprises of dehydrating two aqueous fibrous suspensions to obtain two fibrous webs, joining the two fibrous webs to form a layer compound, dehydrating the layer compound under pressing to form a partially dehydrated layer compound, and spraying the partially dehydrated layer compound on at least one surface side aqueous spray solution or spray suspension to a sprayed layer compound and dehydrating the sprayed layer compound using heat to a multi-layer paper, the aqueous spray solution or spray suspension containing a water-soluble polymer P. Additional objects are a single-layer paper or multi-layer paper obtainable by the process, and a paper machine suitable for the process, which contains a spray device containing the aqueous spray solution or spray suspension with polymer P.

With single-layer and multi-layer papers, the strength in the dried state is an important material property. The firmer a dry paper, the lower the amount of paper with the same absolute strength load, typically the basis weight or the grammage can consequently be reduced with an otherwise comparable paper.

Multi-layer papers are obtained from paper stock mixtures or fibre stock mixtures with the same or different stock composition by pressing together individual, still wet paper webs or layers of paper. An important quality feature of multi-layer packaging papers or cartons is their strength. This is essentially determined by the internal cohesion of the materials used. Ply adhesion in the sense of cohesion in the border area between the individual paper layers can be a weak point. The trend towards the use of increased amounts of recycled raw material leads to shorter and shorter paper fibre lengths and consequently fundamentally poorer paper strengths. Furthermore, there is a trend in folding carton board to use increasingly voluminous fibre mixtures in order to increase bending stiffness. Both trends increase the need to increase ply adhesion.

Adhesive starch or starch derivatives are often used to increase ply adhesion. For example, a native or modified starch based on wheat, corn, potato, tapioca is sprayed onto a paper web in the form of an aqueous suspension. In the dryer section of a paper machine, a gelatinisation occurs and in this way a solidification is affected. The use of native starch often has the disadvantage that due to its high viscosity in aqueous solution only a low solid content can be used. With subsequent heat exposure, the starch compound can also become partially or completely irreversibly brittle.

EP 0953679 A discloses polymers for improving the strength of single and multi-layer papers, which can be obtained by polymerizing at least 5% wt. (meth) acrylic acid and are applied, among other things, by spraying onto a paper layer. In some of the examples, the spraying of a first fibrous web made from a fibrous slurry from old corrugated cardboard and has a moisture content of 86%, with different terpolymers obtained by polymerizing acrylic acid, Acrylamide and Acrylonitrile is described. Then a second fibrous web, which is also made from old corrugated cardboard on a fibrous slurry and has a moisture content of 96%, is connected to the sprayed first fibrous web by pressing. It is then dried and the paper strength of the two-layer papers obtained is determined according to J-TAPPI No. 19-77. In another part of the examples, a wet first fibrous web, which is made from a fibrous slurry from old corrugated cardboard and has a moisture content of 96%, is sprayed with one of the various terpolymers. Afterwards, a single-layer paper is then obtained by pressing and subsequent drying and its paper strength is determined.

According to JP 2007-063682 A, polymers obtained by polymerization of N-Vinylformamide and subsequent, at least partial hydrolysis of the formamide groups, are used in combination with starch to improve the layer adhesion of multi-layer papers. In the examples, the spraying of a first fibrous web, which is made from a fibrous slurry from old corrugated cardboard and has a moisture content of 82%, with various suspensions or solutions containing a starch and/or a polymer solution is described. Then a second fibrous web, which is also made from old corrugated cardboard on a fibrous slurry and has a moisture content of 92%, is connected to the sprayed first fibrous web by pressing. It is then dried at 105° C. and the paper strength of the two-layer papers obtained is determined according to J-TAPPI No. 19-77. Also mentioned as polymers in the examples are a polyallylamine and polymers which are obtained by polymerizing N-Vinylformamide and then at least partially hydrolysing the formamide groups.

The known process for producing single-layer or multi-layer paper or cardboard do not yet fully meet the requirements.

The invention forms the basis to provide a process for producing single-layer or multi-layer paper or cardboard, with which single-layer or multi-layer paper or cardboard with improved strength is obtained. This procedure should be simple to carry out. Furthermore, the strength should be present when exposed to greater shear forces. Splitting is also difficult in the case of multi-layer paper, especially along the original fibrous webs. Further desirable properties include maintaining the strength under the influence of heat or increased moisture when storing the single-layer or multi-layer paper or cardboard produced or during its further processing.

A method has been found for producing dried single-layer or multi-layer paper containing the steps for a single-layer paper (A) Dehydrating a first aqueous fibre suspension, which has a dry matter content between 0.1 wt. % And 6 wt. %, on a first sieve, whereby a first fibrous web, which has a dry matter content between 14 wt. % and 25 wt.-%, arises, (D-1) Dehydrating the first fibrous web by pressing, resulting in a partially dehydrated first fibrous web, (E-1) Spraying the partially dehydrated first fibrous web on at least one surface side with a spray solution or spray suspension, which results in a sprayed partially dehydrated first fibrous web, (F-1) Dehydrating the sprayed partially dehydrated first fibrous web by applying heat to form the dried single-layer paper, or containing the steps for a multi-layer paper (A) Dehydrating a first aqueous fibre suspension, which has a dry matter content between 0.1 wt. % And 6 wt.

%, on a first sieve, whereby a first fibrous web, which has a dry matter content between 14 wt. % and 25 wt.-%, arises, (B) Dehydrating a second aqueous fibre suspension, which has a dry matter content between 0.1 wt. % And 6 wt. %, on a second sieve, whereby a second fibrous web, which has a dry matter content between 14 wt. % and 25 wt.-%, arises, (C) Assembling the first fibrous web to the second fibrous web such that the two fibrous webs touch each other on an entire surface side, thereby resulting in a layer compound, (D-2) Dehydrating the layer compound by pressing, whereby a partially dehydrated layer compound is formed, (E-2) Spraying the partially dehydrated layer compound on at least one surface side with a spray solution or spray suspension, whereby a sprayed layer compound is formed, (F-2) Dehydrating the sprayed layer compound by applying heat results in the dried multi-layer paper, wherein the spray solution or spray suspension contains (e-a) Water (e-b) at least one water-soluble polymer P, which can be obtained by polymerizing (i) 40 to 85 mol % of a monomer of Formula I (I)

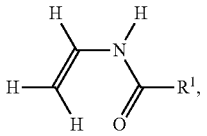

in which $R^1$=H or $C_1$-$C_6$-Alkyl, (ii) 15 to 60 mol % of one or more ethylenically unsaturated monomers which are different from a monomer of the Formula I, wherein the total amount of all monomers (i) and (ii) is 100 mol %, and optionally by subsequent partial or complete hydrolysis of the units of the monomers of the formula (I) polymerized into the polymer P to form primary amino or amidine groups, wherein the proportion of water is at least 75% wt., based on the spray solution or the spray suspension.

A method for producing dried single-layer paper containing the steps is preferred (A) Dehydrating a first aqueous fibre suspension, which has a dry matter content between 0.1 wt. % And 6 wt. %, on a first sieve, whereby a first fibrous web, which has a dry matter content between 14 wt. % and 25 wt.-%, arises, (D-1) Dehydrating the first fibrous web by pressing, thereby creating a partially dehydrated first fibrous web, (E-1) Spraying the partially dehydrated first fibrous web on at least one surface side with a spray solution or spray suspension, which results in a sprayed partially dehydrated first fibrous web, (F-1) Dehydrating the sprayed partially dehydrated first fibrous web by applying heat to form the dried single-layer paper, wherein the spray solution or spray suspension contains (e-a) Water (e-b) at least one water-soluble polymer P, which can be obtained by polymerizing (i) 40 to 85 mol % of a monomer of Formula I (I)

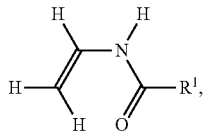

in which $R^1$=H or $C_1$-$C_6$-Alkyl, (ii) 15 to 60 mol % of one or more ethylenically unsaturated monomers which are different from a monomer of the Formula I, wherein the total amount of all monomers (i) and (ii) is 100 mol %, and optionally by subsequent partial or complete hydrolysis of the units of the monomers of the formula (I) polymerized into the polymer P to form primary amino or amidine groups, wherein the proportion of water is at least 75% wt., based on the spray solution or the spray suspension.

A method for producing dried multi-layer paper containing the steps is preferred (A) Dehydrating a first aqueous fibre suspension, which has a dry matter content between 0.1 wt. % And 6 wt. %, on a first sieve, whereby a first fibrous web, which has a dry matter content between 14 wt. % and 25 wt.-%, arises, (B) Dehydrating a second aqueous fibre suspension, which has a dry matter content between 0.1 wt. % And 6 wt. %, on a second sieve, whereby a second fibrous web, which has a dry matter content between 14 wt. % and 25 wt.-%, arises, (C) assembling the first fibrous web to the second fibrous web such that the two fibrous webs touch each other on an entire surface side, thereby resulting in a layer compound, (D-2) Dehydrating the layer compound by pressing, whereby a partially dehydrated layer compound is formed, (E-2) Spraying the partially dehydrated layer compound on at least one surface side with a spray solution or spray suspension, whereby a sprayed layer compound is formed, (F-2) Dehydrating the sprayed layer compound by applying heat results in the dried multi-layer paper, wherein the spray solution or spray suspension contains (e-a) Water (e-b) at least one water-soluble polymer P, which can be obtained by polymerizing (i) 40 to 85 mol % of a monomer of Formula I (I)

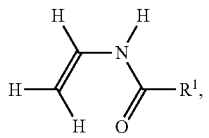

in which $R^1$=H or $C_1$-$C_6$-Alkyl, (ii) 15 to 60 mol % of one or more ethylenically unsaturated monomers which are different from a monomer of the Formula I, wherein the total amount of all monomers (i) and (ii) is 100 mol %, and optionally by subsequent partial or complete hydrolysis of the units of the monomers of the formula (I) polymerized into the polymer P to form primary amino or amidine groups, wherein the proportion of water is at least 75% wt., based on the spray solution or the spray suspension.

Dry content here means the ratio of the mass of a sample after drying to the mass of the sample before drying is expressly understood in percentages by weight (% wt.). The dry content is preferably determined by drying at 105° C. to constant mass. Drying takes place at 105° C. (±2° C.) in a drying cabinet until the mass is constant. Constant mass is achieved here if the rounded first decimal place of the percentage value no longer changes with dry contents of 1 to 100% wt. and the rounded second decimal place of the percentage value no longer changes with dry contents from 0 to less than 1% wt. Drying is carried out at ambient pressure, possibly 101.32 KPa, which is carried out without a correction for a deviation resulting from weather and sea level. In the example section you can find information on practical implementation under Dry content determination.

In step (A), the first aqueous fibrous suspension is understood to be a composition comprising (a-a) Water and (a-b) first fibrous material which contains cellulose fibres. An alternative name for fibre suspension is paper pulp.

Mechanical and/or chemical methods can be used to obtain the first aqueous fibre suspension. For example, grinding an aqueous fibrous suspension is a mechanical process for shortening fibres and, in the case of cellulose fibres, also for defibrillating the fibres. The drainage ability of the first aqueous fibre suspension is also determined by the degree of grinding achieved. One method for measuring the degree of grinding of a fibre suspension is to determine the drainage rate according to Schopper Riegler in units of degree Schopper Riegler (°SR).

Native and/or recovered fibres can be used as the fibre. All fibres commonly used in the paper industry can be used from wood or annual plants. Suitable annual plants to produce fibrous materials are, for example, rice, wheat, sugar cane and kenaf. Wood pulp, e.g. from pine or deciduous wood, includes, for example, wood grinding, thermomechanical material (TMP), chemothermomechanical substance (CTMP), pressure grinding, semi-pulp, high-yield pulp and Refiner Mechanical Pulp (RMP). Rough grinding-mechanical pulp typically has a grinding degree of 40-60° SR compared to normal grinding wood fabric with 60-75° SR and fine-grained wood fabric with 70-80° SR. Pulp, e.g. from pine or deciduous wood, includes the chemically open sulphate, sulphite or soda pulp. Pulp may also be bleached or unbleached. The unbleached pulp which is also called unbleached kraft pulp is preferred. Unground pulp typically has 13-17° SR compared to low or medium milled pulp with 20-40° SR and highly milled pulp with 50-60° SR. Recovered fibres, for example, may come from wastepaper. The wastepaper can optionally be subjected to a deinking process beforehand. Mixed wastepaper can typically have around 40° SR compared to wastepaper from a deinking process with around 60° SR. Recovered fibres from wastepaper can be used alone or in a mixture with other, especially native fibres.

An aqueous fibre suspension can be obtained, for example, by recycling existing paper or cardboard, for example by mechanically treating wastepaper in a pulper together with water until the aqueous fibre suspension has the desired consistency. Another example of the combination of two fibre sources is the mixing of a primary fibre suspension with recycled scrap of a coated paper, which is produced using the primary fibre suspension.

In addition to water, the first aqueous fibrous suspension can contain further constituents which may optionally be added to it consciously or may be present with the use of wastepaper or existing paper.

With a dry content of 2 wt.-% to 4 wt.-%, based on the aqueous fibre suspension (equivalent to approximately a fibre concentration of 20 to 40 g/L if fibre is almost exclusively present), is usually referred to as thick matter in paper production. This is usually distinguished as a thin material with a dry content of 0.1 wt.-% to less than 2 wt. % based on the aqueous suspension of the fibre (equivalent to a fibrous concentration of 1 to less than 20 gVL if almost exclusively fibre material is present), in particular 0.5 wt.-% to 1.5 wt. % (5 to 15 g/L). The dry content or the dry weight of an aqueous fibrous suspension comprises of all constituents which are not volatile or are preferably non-volatile when dry content is determined by drying at 105° C. to a constant mass.

Another possible component of the first aqueous fibre suspension is (a-c) an organic polymer that is different from a fibre. The organic polymer (a-c) can be neutral, cationic or anionic.

A neutral organic polymer (a-c) can be uncharged-neutral because it contains no polymer units with a functional group that carries a charge at least at pH 7. A functional group which carries a charge at least at a pH 7 is understood here to mean an atom or a connected group of atoms which is covalently bonded to the rest of the polymer unit. The functional group permanently carries a charge or acts on its own, i.e. independent of other constituents of the polymer unit or other polymer units, in their uncharged form in pure water as acid or as base. The acid effect leads to the formation of a negative charge on the corresponding functional group of the polymer unit when deprotonating with a base. This can be done, for example, with NaOH, KOH or NH3, which are typically used in aqueous solution, and lead to the corresponding sodium, potassium or ammonium salts.

The base effect leads to the formation of a positive charge on the corresponding functional group of the polymer unit when protonating with an acid. This can be done, for example, using HCl, H2SO4, H3PO4, HCOOH or H3CCOOH, which are typically used in aqueous solution, and lead to the corresponding chloride, hydrogen sulphate/sulphate, dihydrogen phosphate/hydrogen phosphate/phosphate, formate or acetate salts. An example of a functional group with a permanent positive charge is $—(CH_2—)_4N^+$ (a tetraalkylated nitrogen) such as, for example, that in diallyldimethylammonium or in 2-(N, N, N-trimethylammonium) ethyl acrylate. Examples of a functional group which leads to the formation of negative charges in the polymer unit are —COOH (a carboxylic acid), —SO2OH (a sulfonic acid), $—PO(OH)_2$ (a phosphonic acid), $—O—SO_2OH$ (a monoesterified Sulphuric acid) or $—O—PO(OH)_2$ (a monoesterified phosphoric acid). Examples of a functional group which lead to the formation of positive charges in the polymer unit are $—CH_2—CH(NH_2)—$ or $—CH_2—NH_2$ (a primary and basic amino group), $(—CH_2—)_2NH$ (a secondary and basic one Amino group), $(—CH_2—)_3N$ (a tertiary and basic amino group) or $(-)_2CH—N═CH—NH—CH(-)_2$ (a basic amidine group, especially in the form of a cyclic amidine).

Examples of a neutral organic polymer (a-c) which does not contain any polymer units with a functional group which carries a charge at least at a pH of 7 are polyacrylamide, poly (acrylamide-co-acrylonitrile), poly (vinyl alcohol) or poly (vinyl alcohol-co-vinyl acetate).

A neutral organic polymer (a-c) can also be amphoteric-neutral because it contains polymer units with a functional group that bears a negative charge of at least pH 7, and polymer units with a functional group of at least a pH 7 carries a positive charge, and the number of all negative charges and the number of all positive charges of the functional groups continue to balance. An organic polymer in which the number of positive charges differs from that number of negative charges by less than 7 mol % units is also considered to be amphoteric-neutral, 100 mol % units being the number of all polymerized monomers for the preparation of the organic polymers. For example, an organic polymer which is formed by polymerizing 30 mol % acrylic acid and 70 mol % N-vinylformamide and in which half of the polymerized N-vinylformamide units are further hydrolysed, with 5 mol % units difference between the functional groups —COOH and —$CH_2$—$CH(NH_2)$— is regarded amphoterically neutral. In the case of the polymerization of 10 mol % itaconic acid (HOOC—$CH_2$—C(=$CH_2$)—COOH), 10 mol % acrylic acid and 80 mol % N-vinylformamide to form an organic polymer, in which 44% of the copolymerized N-vinylformamide-Units are hydrolysed, the polymer is regarded as amphoterically neutral at 5 mol %-units difference between the functional groups —COOH and —$CH_2$—$CH(NH_2)$—.

A cationic organic polymer (a-c) can be purely cationic, i.e. it contains polymer units with a functional group that carries a positive charge at least at pH 7, but it does not contain polymer units with a functional group that carries a negative charge at least at pH 7. Examples of a pure cationic organic polymer (ac) are poly (allylamine), poly (diallylamine), poly (diallyldimethylammonium chloride), poly (acrylamide-co-diallyldimethylammonium chloride) or poly (acrylamide-co-2-(N, N, N-trimethylammonium)ethylacrylate chloride).

A cationic organic polymer (a-c) can also be amphoteric-cationic, i.e. it contains polymer units with a functional group that carries a positive charge at least at a pH 7, and polymer units with a functional group that carries a negative charge at least at a pH 7, and the number of all positive charges is higher than the number of all negative charges of the functional groups. An organic polymer in which the number of positive charges differs from that number of negative charges by equal or more than 7 mol % units is considered to be amphoteric-cationic, 100 mol % units being the number of all polymerized monomers for the preparation of the organic polymers. For example, an organic polymer which is formed by polymerizing 30 mol % acrylic acid and 70 mol % N-vinylformamide and in which 57% of the polymerized N-vinylformamide units are further hydrolysed, with 10 mol % units difference between the functional groups —COOH and —$CH_2$—$CH(NH_2)$— is regarded amphoterically cationic.

An anionic organic polymer (a-c) can be purely anionic, i.e. it contains polymer units with a functional group that carries a negative charge at least at pH 7, but it does not contain polymer units with a functional group that carries a positive charge at least at pH 7. Examples of a purely anionic organic polymer (a-c) are poly (acrylic acid), poly (styrene-co-n-butyl acrylate-co-acrylic acid) or poly (acrylamide-co-acrylonitrile-co-acrylic acid).

An anionic organic polymer (a-c) can also be amphoteric-anionic, i.e. it contains polymer units with a functional group that carries a negative charge of at least pH 7, and polymer units with a functional group that carries a positive charge of at least pH 7 and the number of all negative charges higher than the number of all positive charges of the functional groups. An organic polymer in which the number of negative charges differs from that number of positive charges by equal or more than 7 mol % units is considered to be amphoteric-anionic, 100 mol % units being the number of all polymerized monomers for the preparation of the organic polymers. For example, an organic polymer which is formed by polymerizing 30 mol % acrylic acid and 70 mol % N-vinylformamide and in which 29% of the polymerized N-vinylformamide units are further hydrolysed, with 10 mol % units' difference between the functional groups —COOH and —$CH_2$—$CH(NH_2)$— is regarded amphoterically anionic.

The organic polymer (a-c) can also be differentiated according to linear, branched or cross-linked. Crosslinking can take place, for example, by adding a crosslinker already during the polymerization of the starting monomers or by adding a crosslinker after the polymerization has taken place, in particular also only shortly before the addition of the organic polymer (a-c) to the aqueous fibre suspension. For example, polyacrylamide can be crosslinked during the polymerization by adding the crosslinking agent methylene bisacrylamide to acrylamide, or a crosslinking agent such as glyoxal can be added only after the polymerization. If necessary, both types of crosslinking can be combined. A crosslinked organic polymer which has a high degree of crosslinking, typically already during the monomer polymerization should be particularly mentioned. This is present in the first aqueous fibre suspension as particles, as so-called organic micro particles.

The organic polymer (a-c) can also be differentiated according to natural, modified-natural or synthetic. A natural organic polymer is usually obtained from nature, where appropriate isolation steps are used, but no specific chemical-synthetic modification. An example of a natural organic polymer (a-c) is unmodified starch. No example of a natural organic polymer (a-c) is cellulose—this is a fibrous material (a-b). A modified-natural organic polymer is modified by a chemical-synthetic process step. An example of a modified natural organic polymer (a-c) is cationic starch. A synthetic organic polymer (a-c) is obtained chemically and synthetically from individual monomers. An example of a synthetic organic polymer (a-c) is polyacrylamide.

An organic polymer (a-c) also includes two or more different organic polymers. Accordingly, an organic polymer (a-c) then divided as a possible further component of the first aqueous fibre suspension into a first organic polymer (a-c-1), a second organic polymer (a-c-2), etc.

Another possible component of the first aqueous fibre suspension is (a-d) a filler. A filler (a-d) is an inorganic particle, an inorganic pigment. Suitable inorganic pigments are all pigments based on metal oxides, silicates and/or carbonates that can usually be used in the paper industry, in particular pigments from the group consisting of calcium carbonate, in the form of ground lime, chalk, marble (GCC) or precipitated calcium carbonate (PCC) can be used, talc, kaolin, bentonite, satin white, calcium sulphate, barium sulphate and titanium dioxide. An inorganic particle is also a colloidal solution of polysilicic acids, in which the silica particles typically have a particle size between 5 and 150 nm.

A filler (a-d) herein can also be two or more different fillers. Accordingly, a filler (a-d) as a possible further component of the first aqueous fibre suspension is divided into a first filler (a-d-1), a second filler (a-d-2), etc.

Inorganic pigments with an average particle size (volume average) 10 10 μm, preferably from 0.3 to 5 μm, from up to 0.5 to 2 μm, are preferably used. The mean particle size (volume average) of the inorganic pigments and the particles of the powder composition are generally determined in the context of this document by the quasi-elastic light scattering method (DIN-ISO 13320-1), for example using a Mastersizer 2000 from Malvern Instruments Ltd.

Another possible component of the first aqueous fibre suspension is (a-e) another paper additive. Another paper additive (a-e) is different from the components (a-b), (a-c) and (a-d). Another paper additive (a-e) is, for example, a mass sizing agent, a water-soluble salt of a trivalent metal cation, a defoamer, a non-polymeric wet strength agent, a biocide, an optical brightener or a paper dye. Examples of a mass sizing agent are alkylketene dimers (AKD), alkenyl succinic acid anhydrides (ASA) and resin glue. Examples of a water-soluble salt of a trivalent metal cation are aluminium (III) salts, in particular $AlCl_3$ such as e.g. $AlCl_3.6H_2O$, $Al_2(SO_4)_3$ such as e.g. $Al_2(SO_4)_3.18H_2O$, or KAI $(SO_4)_2.12H_2O$.

Another paper additive (a-e) herein also includes two or more different other paper additives. Correspondingly, another paper additive (a-e) then divides as a possible further component of the first aqueous fibre suspension into a first different paper additive (a-e-1), a second different paper aid (a-e-2), etc.

In the paper production process, more than one organic polymer (a-c) and more than one filler (a-d) are often added to the first aqueous fibre suspension. In the case of an organic polymer (a-c), this serves, for example, to influence technical properties of the paper manufacturing process itself or technical properties of the paper produced. Retention agents, drainage agents, wet strength agents or dry strength agents are used.

Examples of a retention agent are cationic, amphoteric or anionic organic polymers (a-c). Examples are an anionic polyacrylamide, a cationic polyacrylamide, a cationic starch, a cationic polyethyleneimine or a cationic polyvinylamine. A retention agent is, for example, a filler (a-d) which is an anionic microparticle, colloidal silicic acid or bentonite. Combinations of the examples are also possible. A combination is to be mentioned as a dual system which consists of a cationic polymer with an anionic micro particle or an anionic polymer with a cationic micro particle. A preferred retention agent is a synthetic organic polymer (a-c) or a dual system. In the case of a dual system as a retention agent, there is already a cationic first organic polymer (a-c-1) in combination with a first filler (a-d-1), for example a suitable bentonite, and a second filler (a-d-2) then calcium carbonate.

The first fibre suspension preferably contains an organic polymer (a-c), which is a synthetic organic polymer. An organic polymer (a-c) which is a polyacrylamide is preferred. An organic polymer (a-c) which is a cationic polyacrylamide is preferred. An organic polymer (a-c) which is a cationic polyacrylamide and acts as a retention agent is particularly preferred.

The amount of weight of organic polymer (a-c) is preferably 0.001% wt. to 0.2% wt., based on the amount wt. of first fibre (a-b) in the first fibre suspension. The amount wt. of first fibrous material (a-b) relates to the dry matter content of first fibrous material (a-b) and the amount wt. of organic polymer (a-c) relates to the solid content of organic polymer (a-c). The solids content of the organic polymer (a-c) is determined from a material sample of the organic polymer (a-c) by drying this sample in a forced-air drying cabinet at 140° C. for 120 minutes. For example, in the case of an aqueous polymer solution, -suspension or -emulsion, the sample is placed in a metal lid for drying. Drying is carried out at ambient pressure, possibly 101.32 KPa, which is carried out without a correction for a deviation resulting from weather and sea level. The amount wt. of organic polymer (ac) is very preferably 0.005% wt. to 0.1% wt. based on the amount wt. of first fibre (ab) in the first fibre suspension, particularly preferably 0.01% wt. to 0.08% wt, very particularly preferably 0.02% wt. to 0.06% wt. and particularly preferably 0.3% wt. to 0.05% wt.

The amount wt. of organic polymer (a-c), which is a cationic polyacrylamide, is preferably 0.001% wt. to 0.2% wt., based on the amount wt. of first fibre (a-b) in the first fibre suspension.

An anionic organic polymer is preferably not added to the first fibrous suspension.

Examples of a dry strength agent are a synthetic organic polymer (a-c) such as, for example, polyvinylamine, polyethyleneimine, polyacrylamide or glyoxylated polyacrylamide, or a natural organic polymer (a-c) such as unmodified starch.

The dry content of the first aqueous fibre suspension is preferably between 0.11% wt. and 5% wt., highly preferable between 0.12% wt. and 4% w.t, particularly preferable between 0.13% wt. and 3% wt., 2% wt., 1% wt., 0.6% wt. or 0.35% wt. as the upper limit and very highly preferred between 0.14% wt. and 0.30% wt.

The first sieve, which has a first sieve top and a first sieve bottom, has sieve meshes as openings. The first aqueous fibrous suspension is applied to the sieve via the headbox. The headbox ensures that the fibrous stock suspension is applied evenly and across the entire width of the sieve. apart from the sieve mesh or other material-related bumps and a certain radius bend in the case of a ring sieve. This allows to produce a uniformly thin, as homogeneous as possible fibrous web. After application of the first fibrous suspension, parts of the water (a-a) of the first aqueous fibrous suspension run through the sieve meshes, whereupon sheets form on the first sieve top and the first fibrous web is formed. A fibrous web so produced is flat, i.e. it has a very small height in relation to length and width. The fibrous material of the fibrous material suspension as well as possible other components that should be present in the paper ultimately produced, for example a filler, are ideally retained entirely or at least essentially in the fibrous web that is formed. Possible further components of the fibrous suspension, which are added to support the retention of the other components, to support dehydration of the fibrous suspension or to support uniform sheet formation, for example an organic polymer, develop their effect in this process. In most cases, these possible further components of the fibrous suspension remain entirely or at least essentially in the resulting fibrous web. The dry portion of the fibrous web, which determines the dry content of the fibrous web, contains the retained constituents of fibrous material, possible other components that are supposed to be present in the paper ultimately produced, and the possible further components. Depending on their retention behaviour, these constituents are, for example, the fibre, organic polymers, fillers and other paper additives. At the end of step (A) the fibrous web is firm enough to be able to remove it from the sieve.

The sieve contains, for example, a metal or plastic mesh. Preferably, the sieve is an endless sieve. After the resulting fibrous web is separated from an endless sieve, the endless sieve runs back to the material application, in which new fibrous suspension is applied to the running endless sieve. Highly preferable is a sieve with an endless sieve that runs around several rollers. Known screen types for endless sieves are the fourdrinier sieve, the twin sieve former with an endless bottom sieve and one of its additional endless top sieves, the cylindrical sieve and the cylinder mould formers. A fourdrinier sieve is preferred.

The dehydration of the fibrous suspension on the top of the sieve can be supported by applying a vacuum to the underside of the sieve. The vacuum is understood to be a lower pressure than the pressure on the top of the sieve, which corresponds, for example, to the ambient pressure.

The dry content of the first fibrous web is preferably 15% wt. to 24% wt., highly preferable at 16% wt. to 23% wt., particularly preferable at 17% wt. to 22% wt., very highly preferable at 17.5% wt. to 22% wt. and especially preferable at 18% wt. to 21% wt.

The square meter weight of a fibrous web is defined here as the mass of components per square meter of fibrous web that remain on drying, preferably remain as a constant mass in the dry content determination at 105° C. drying temperature. The square meter weight of a fibrous web is preferred at 20 to 120 g/m2. For both single-layer paper and multi-layer paper, the square meter weight of the first fibrous web or the sum of all square meter weights of the fibrous webs is not necessarily exactly the square meter weight of the dried single-layer or multi-layer paper. In the example of multi-layer paper, the sum of all the square meter weights of the fibrous webs is not the grammage of the dried multi-layer paper ultimately produced there from, because at least one of the layers as a fibrous web is still sprayed with a small increase in grammage, the layer compound when dehydrating by pressing and more formally when dehydrating via heated Cylinder could lose some of the above-mentioned components again after drying with a low grammage or, with the said dehydration or other steps, the dried multi-layer paper or its moist precursors could be stretched or compressed. In the latter case, one square meter of the fibrous web would no longer correspond to one square meter of the dried multi-layer paper. On the other hand, approximately the square meter weight of the flat first fibrous web can correspond to the dried single-layer paper or the proportion of the layer resulting from this fibrous web in the further process for a multi-layer paper in the total grammage of the dried multi-layer paper. The weight per square meter of the first fibrous web is, for example 30 to 100 g/m$^2$, 30 to 60 g/m$^2$, 65 to 105 g/m$^2$, 35 to 50 g/m$^2$ or 70 to 90 g/m$^2$.

In step (B), the second aqueous fibrous suspension is understood to mean a composition comprising (b-a) Water and (b-b) second fibrous material which contains cellulose fibres. The explanations and preferences for step (A) apply mutatis mutandis to step (B), with an organic polymer (b-c) or a first organic polymer (b-c-1) and a second organic polymer (b-c-2) etc. correspondingly, a filler (b-d) or a first filler (b-d-1) and a second filler (b-d-2) etc., another paper additive (b-e) or a first different paper additive (b-e-1) and a second other paper additive (b-e-2), a second sieve, which has a second sieve top and a second sieve bottom, a second fibrous web and a square meter weight of the second fibrous web are meant.

The second fibre (b-b) is preferably the same as the first fibre (a-b). The organic polymer (b-c) is preferably the same as the organic polymer (a-c) or the first organic polymer (b-c-1) is the same as the first organic polymer (a-c-1); the first organic polymer (b-c-1) is very preferably the same as the first organic polymer (a-c-1) and the second organic polymer (b-c-2) equal to the second organic polymer (a-c-2). The second organic polymer (b-c) is preferably contained in the same amount wt. per second fibrous material (b-b) as the first organic polymer (a-c) per first fibrous material (a-b). The amount wt. of organic polymer (a-c), which is a cationic polyacrylamide, is preferably at 0.001% wt. to 0.2% wt. based on the amount wt. of first fibre (a-b) in the first fibre suspension and the amount wt. of organic polymer (b-c), which is a cationic polyacrylamide, 0.001 wt % to 0.2 wt % based on the amount wt. of second pulp (b-b) in the second fibrous suspension. The filler (b-d) is preferably the same as the filler (a-d) or the first filler (b-d-1) is the same as the first filler (a-d-1), and the first filler (b-d-1) is very preferably the same as the first filler (a-d-1) and the second filler (b-d-2) equal to the second filler (a-d-2). The other paper additive (b-e) is preferably the same as the other paper additive (a-e) or the first other paper additive (b-e-1) is the same as the first other paper additive (a-e-1), very preferably the first other paper additive (b-e-1) is the same the first other paper additive (a-e-1) and the second other paper additive (b-e-2) the same as the second other paper additive (a-e-2). The composition of the second fibrous suspension is preferably the same as the composition of the first fibrous suspension. The square meter weight of the first fibrous web is preferably higher than the square meter weight of the second fibrous web, very preferably the square meter weight of the first fibrous web is 65 to 105 g/m2 and the square meter weight of the second fibrous web is 30 to 60 g/m2.

An organic polymer (a-c) is preferably added to the first aqueous fibrous suspension, containing (a-a) water and (a-b) first fibre, before dehydrating in step (A) as a retention agent. The amount of polymer (a-c) added is highly preferred at 0.001% wt. to 0.2% wt., based on the first fibre material (a-b). The amount of polymer (a-c) added is particularly preferred at 0.020% wt. to 0.15% wt. With these amounts, the polymer (a-c) is very highly preferred as a cationic polymer and particularly preferred as a cationic polyacrylamide.

An organic polymer (a-c) is preferably added to the first aqueous fibre suspension, containing (a-a) water and (a-b) first fibre, before dehydration in step (A) as a retention agent, and the second aqueous fibre suspension, containing (b-a) water and (b-b) second fibre, before dehydration in step (B) an organic polymer (b-c) added as a retention agent. The amount of polymer (a-c) added is highly preferable at 0.001% wt. to 0.2% wt., based on the first fibrous material (a-b) and the amount of organic polymer (b-c) added is 0.001% wt. up to 0.2 wt.-% based on the second fibre (b-b). The amount of polymer (a-c) added is particularly preferable at 0.020% wt. to 0.15% wt. and the amount of polymer (b-c) added is 0.0020% wt. to 0.15% wt. With these amounts, the polymer (a-c) and the polymer (b-c) are very highly preferable as a cationic polymer and particularly preferable as a cationic polyacrylamide.

In step (A), the first fibrous suspension is preferably applied to the top of the first sieve and the dehydration is supported by applying a vacuum to the first underside of the sieve, in step (B) the second fibrous suspension is applied to the top of the second sieve and dehydration by applying a vacuum to the second underside of the sieve, or in step (A) the first fibrous suspension is applied to the top of the first sieve and dehydration is supported by applying a vacuum to the first underside of the sieve, and in step (B) the second fibrous suspension is applied to the upper side of the second sieve and the dehydrating is supported by applying a vacuum to the second underside of the sieve. In step (A), the first fibrous suspension is preferably applied to the top of the first sieve and the dehydration is supported by applying a vacuum to the first underside of the sieve, and in step (B) the second fibrous suspension is applied to the top of the second sieve and the dehydration is supported by applying a vacuum to the second underside of the sieve.

In step (C), the joining of the first fibrous web with the second fibrous web ensures the formation of the layer compound. A flat side of the first fibrous web comes into permanent contact with a flat side of the second fibrous web. When joining, the surface sides touch at least to such an extent that the fibrous webs then adhere weakly to each another. The fibrous webs are arranged or merged so that the entire width of the fibrous webs lie one above the other or the fibrous webs cover one another over the entire surface. The assembly corresponds to a complete stacking of the first fibrous web and the second fibrous web. The assembly takes place, for example, in terms of space and time almost immediately before pressing step (D-2).

In step (D-1), the first fibrous web is pressed, which leads to a further dehydration and a corresponding increase in the dry content in the partially dehydrated first fibrous web. Step (D-1) begins when the first fibrous web from step (A) reaches the so-called forming line. During forming, dehydration takes place under the exertion of mechanical pressure on the first fibrous web.

In step (D-2), the layer compound is pressed, which leads to a further dehydration and a corresponding increase in the dry matter content in the partially dehydrated layer compound. Step (D-2) begins when the layer compound from step (C) reaches the so-called forming line. When forming, dehydration takes place under the exertion of mechanical pressure on the layer compound.

Removing water by mechanical pressure is more energy efficient than removing water by adding heat or drying. By placing the first fibrous web or the layer compound on a water-absorbent belt, e.g. a felt-like fabric, the drainage is supported by the absorption of the pressed water. A roller is suitable for exerting pressure on the layer compound. Passing the layered compound through two rollers is particularly suitable for optionally resting on the water-absorbent belt. The surface of the roller consists for example of steel, granite or hard rubber. The surface of a roller can be coated with a water-absorbent material. The water-absorbent materials have a high degree of absorbency, porosity, strength and elasticity. After contact with the first fibrous web or the layer compound, the water-absorbent materials are ideally dehydrated again on a side facing away from the first fibrous web or the layer compound, e.g. by a squeegee.

At the end of step (D-1), a partially dehydrated first fibrous web was created. At the end of step (D-1), the partially dehydrated first fibrous web is firm enough to be fed to the next step without mechanical support. The partially dehydrated first fibrous web has, for example, a dry content between 35% wt. and 65% wt. The partially dehydrated first fibrous web preferably has a dry content between 37% wt. and 60% wt., highly preferable between 38% wt. and 55% wt., particularly preferable between 39% wt. and 53% wt., highly preferable between 40% wt. and 52% wt.

At the end of step (D-2), a partially dehydrated layer network has been created. At the end of step (D-2), the partially dehydrated layer compound is firm enough to be fed to the next step without mechanical support. The partially dehydrated layered compound, for example, has a dry content between 35% wt. and 65% wt. The partially dehydrated layer compound preferably has a dry content between 37% wt. and 60% wt., highly preferable between 38% wt. and 55% wt., particularly preferable between 39% wt. and 53% wt., highly preferable between 40% wt. and 52% wt.

Spraying in step (E-1) or (E-2) with the spray solution or spray suspension is preferably carried out using a spray attachment. The spray attachment contains, for example, one or more nozzles. The spray solution or the spray suspension is sprayed from the nozzle or nozzles onto the flat side of the partially dehydrated layer compound. The spray solution or spray suspension is preferably under an overpressure relative to the ambient pressure, for example 0.5 to 15 bar, preferably 0.5 to 4.5 bar and highly preferable at 0.8 to 2.5 bar. The overpressure is built up shortly before it leaves the nozzle. A container for storing the spray solution or spray suspension can be part of the spray device. The partially dehydrated first fibrous web or the partially dehydrated layer compound each have two flat sides. A flat side or both flat sides of the partially dehydrated first fibrous web or the partially dehydrated layer compound can be sprayed in step (E-1) or (E-2). Exactly one flat side of the partially dehydrated first fibrous web or the partially dehydrated layer compound is preferably sprayed.

In step (F-1) there is a further dehydration of the sprayed partially dehydrated first fibrous web from step (E-1) by supplying heat, whereby the dried single-layer paper is produced at the end of step (F-1). The heat supply to the sprayed partially dehydrated first fibrous web is carried out, for example, by heated cylinders, over which the sprayed partially dehydrated first fibrous web is guided, by IR radiators, through warm air, which is passed over the sprayed partially dehydrated first fibrous web, or by a combination of two or all three measures.

In step (F-2) there is a further dehydration of the sprayed layer compound from step (E-2) by supplying heat, whereby the dried multi-layer paper is produced at the end of step (F-2). The heat supply to the sprayed partially dehydrated first fibrous web of the partially dehydrated layer compound takes place, for example, through heated cylinders, over which the sprayed layer compound is guided, through IR radiators, through warm air, which is conducted over the sprayed layer compound, or through a combination of two or all three procedures.

The heat is supplied preferably using heated cylinders. The cylinders can be heated by electricity or steam. Typical cylinder temperatures are 120 to 160° C. A cylinder can have a coating on its surface which results in a better surface quality of the dried single-layer paper or multi-layer paper. The dried single-layer paper has the highest strength in comparison with the strength of the first fibrous web, the partially dehydrated first fibrous web or the sprayed partially dehydrated first fibrous web. The dried multi-layer paper has the highest strength in comparison with the first fibrous web or the combined strengths of all fibrous webs, with a layer compound, with a partially dehydrated layer compound or with a sprayed layer compound. According to a presumption, from a dry content of 80% wt., the hydroxyl groups of cellulose fibres are increasingly bonded via hydrogen bonds, which supplements the previous mechanical felting of the fibres. A measure of the strength of the dried single-layer paper or the dried multi-layer paper is, for example, the internal strength. The internal strength is preferably a measure of the strength of the dried multi-layer paper.

A dried single-layer paper or a dried multi-layer paper is defined herein as a sheet material that has a grammage, i.e. has a basis weight of the dried paper of up to 600 g/m$^2$. The produced paper in the narrower sense is typically used for grammages up to 225 g/m$^2$ while the produced cardboard is used for grammages from 150 g/m$^2$.

The grammage of the dried single-layer paper or the dried multi-layer paper is preferably 20 to 400 g/m$^2$, highly preferable at 40 to 280 g/m$^2$, particularly preferable at 60 to 200 g/m$^2$, very highly preferable at 80 to 160 g/m$^2$, specially preferable at 90 to 140 g/m$^2$ and is specially preferable at 100 to 130 g/m$^2$.

The dried multi-layer paper preferably has two, three or four layers, very preferably two or three layers and particularly preferable at two layers. In the case of two layers, there is exactly one first fibrous web and one second fibrous web in the process. With three layers there is an additional fibrous web as the third fibrous web and with four layers there is another additional fibrous web as the fourth fibrous web. A third and possibly a fourth fibrous web are connected to the layer compound of the first fibrous web and the second fibrous web. Then steps (D-2), (E-2) and (F-2) take place.

The first fibrous web and the second fibrous web each contribute to the grammage of the dried multi-layer paper. These contributions can be the same or different. The contributions result approximately from the square meter weights of the respective fibrous web. The contribution of the first fibrous web to the grammage of the dried multi-layer paper is preferably higher than the contribution of the second fibrous web, very preferably the ratio is 3 or more parts of the first fibrous web to 2 or fewer parts of the second fibrous web. The ratio of 3 or more parts of the first fibrous web to 2 or fewer parts of the second fibrous web to 4 parts of the first fibrous web to 1 part of the second fibrous web is particularly preferred.

The dry content of the dried single-layer paper or the dried multi-layer paper is, for example, at least 88% wt. The dry content of the dried single-layer paper or the dried multi-layer paper is preferably between 89% wt. and 100% wt., highly preferable between 90% wt. and 98% wt., particularly preferable between 91% wt. and 96% wt., very highly preferable between 92% wt. and 95% wt. and particularly preferable between 93% wt. and 94% wt.

The process for making dried single-layer or multi-layer paper can include other steps. For example, step (F-1) or step (F-2) can be followed by calendering of the dried single-layer or multi-layer paper.

A procedure is preferred in which, after step (D-1) and before step (F-1), no application of a material by immersing the partially dehydrated first fibrous web or the sprayed partially dehydrated first fibrous web in an aqueous solution or painting a surface side of the partially dehydrated first fibrous web or the sprayed partially dehydrated first fibrous web is carried out using an aqueous solution. A method is very preferred in which after step (D-1) and before step (F-1) with the exception of step (E-1) no application of a material contributes to the increase of grammage of the dried single-layer paper by at least 2 g/m$^2$. A method is particularly preferred in which after step (D-1) and before step (F-1) with the exception of step (E-1) no application of a material contributes to the increase of grammage of the dried single-layer paper by at least 1 g/m$^2$. A method is very particularly preferred in which after step (D-1) and before step (F-1) only step (E-1) applies a material which contributes to the increase of grammage of the dried single-layer paper.

A procedure is preferred in which, after step (D-2) and before step (F-2), no application of a material by immersing the partially dehydrated layer compound or the sprayed layer compound in an aqueous solution or painting a flat side of the partially dehydrated layer compound or the sprayed layer compound takes place using an aqueous solution. A method is very preferred in which after step (D-2) and before step (F-2) with the exception of step (E-2) no application of a material contributes to the increase of grammage of the dried multi-layer paper by at least 2 g/m$^2$. A method is particularly preferred in which after step (D-2) and before step (F-2) with the exception of step (E-2) no application of a material contributes to the increase of grammage of the dried multi-layer paper by at least 1 g/m$^2$. A method is very particularly preferred in which after step (D-2) and before step (F-2) only step (E-2) applies a material which contributes to the increase of grammage of the dried multi-layer paper.

A polymer P is water-soluble if its solubility in water under normal conditions (20° C., 1013 mbar) and pH 7.0 is at least 5% wt., preferably is at least 10% wt. The weight percentages relate to the solid content of polymer P. The fixed content of polymer P is determined after its preparation as an aqueous polymer solution. A sample of the polymer solution in a sheet metal lid is dried in a forced air-drying cabinet at 140° C. for 120 minutes. Drying takes place at ambient pressure, possibly at 101.32 KPa, which is carried out without a correction for a deviation resulting from weather and sea level.

The spray solution or spray suspension preferably has a pH of 5.5 or greater. The spray solution or spray suspension has a pH highly preferable between 5.8 and 12, particularly preferable between 6.2 and 11, very particularly preferable between 6.4 and 10, particularly preferable between 6.8 and 9 and especially preferable between 7.2 and 8.8.

Due to the high-water content, the density of the spray solution or spray suspension can be assumed to be approximately 1 g/cm$^3$.

The spray solution or spray suspension preferably contains (e-a) Water (e-b) at least one polymer P (e-c) optionally another layer connector, which is different from a polymer P, (e-d) optionally a spraying aid which is different from a polymer P and the further layer connector, wherein the water (e-a) content is at least 80% wt., based on the weight of the spray solution or spray suspension.

The spray solution or spray suspension preferably contains between at least 85% wt. and 99.99% wt. water (e-a), based on the total weight of the spray solution or spray suspension, very preferably between at least 95% wt. and 99.95% wt. % Water, particularly preferable between 98% wt. and 99.9% wt. of water and more particularly preferable between 99% wt. and 99.7% wt. of water.

The spray solution or spray suspension preferably contains between 0.01% wt. and less than 15% wt. of polymer P (e-b), based on the total weight of the spray solution or spray suspension, preferable between 0.05% wt. and less than 5% wt. of % Polymer P, particularly preferable between 0.1% wt. and less than 2% wt. polymer P, very highly preferable between 0.15% wt. and less than 1% wt. polymer P and particularly preferable between 0, 3% wt. and less than 0.8% wt. of polymer P. The weight of polymer P in a spray solution or spray suspension relates to the solid content of polymer P.

The further layer connector (e-c), which is different from a polymer P, is, for example, an organic polymer. A natural polysaccharide, a modified polysaccharide, a protein or a polyvinyl alcohol is preferred. A mixture of several layer connectors is also included. A natural polysaccharide is, for example, natural starch or guar flour. A modified polysaccharide is, for example, a chemically modified starch or a cellulose ether. A protein is, for example, gluten or casein. For example, a cellulose ether is carboxymethyl cellulose.

Example of a natural starch is a starch from corn, wheat, oats, barley, rice, millet, potato, peas, cassava, black millet or sago. Degraded starch herein has a reduced weight average molecular weight compared to natural starch. The starch can be broken down enzymatically, by oxidation, acid impact or base impact. Enzymatic degradation and degradation by the action of acids or bases leads to increased levels of oligosaccharides or dextrins in the presence of water via hydrolysis. Some degraded starches are commercially available. The degradation of starch is a chemical process. The chemical modification herein is a functionalization of a natural starch by covalently attaching a chemical group or breaking covalent bonds in the starch. A chemically modified starch can be obtained, for example, by esterification or etherification of a natural starch followed by starch degradation. The esterification can be supported by an inorganic or an organic acid. For example, an anhydride of acid or a chloride of acid is used as the reagent. A common procedure for etherifying a starch involves treating the starch with an organic reagent containing a reactive halogen atom, an epoxy functionality or a sulphate group in an alkaline, aqueous reaction mixture. Known etherification types of starches are alkyl ethers, uncharged hydroxyalkyl ethers, carboxylic acid alkyl ethers or 3-trimethylammonium-2-hydroxypropyl ether. A chemically modified starch is, for example, phosphated degraded starch and acetylated degraded starch. A chemically modified starch can be neutral, anionic or cationic.

The further layer connector (e-c) can be neutral, anionic or cationic. Neutral is divided into uncharged neutral and amphoteric neutral. The distinction is made according to the definitions given for the organic polymer (a-c). Uncharged neutral means that at pH 7 there are no charged atoms or functional groups. Amphoteric neutral means that at pH 7 there are both atoms or functional groups with a positive charge and atoms or functional groups with a negative charge, but the total charges differ by less than 7 mol %, all of which charges at 100 mol %. Cationic divides itself into purely cationic and amphoteric-cationic. Anionic divides itself into pure anionic and amphoteric-anionic. Another layer connector (e-c) which is uncharged-neutral, amphoteric-neutral, purely anionic, amphoteric-anionic or amphoteric is highly preferred. Another layer connector (e-c) which is neutral or anionic is particularly preferred. Another layer connector (e-c) which is uncharged-neutral or purely anionic is very highly preferred. Another layer connector (e-c) is particularly preferred which is uncharged-neutral.

The spray solution or spray suspension preferably contains between 0% wt. and 15% wt. of a further layer connector (e-c) based on the total weight of the spray solution or spray suspension. The amount of further layer connector (e-c) is highly preferable between 0.05% wt. and less than 5% wt. of further layer connector (e-c), particularly preferable between 0.1% wt. and less than 2% wt. on another layer connector (e-c), very highly preferable between 0.15% wt. and less than 1% wt. of another layer connector (e-c) and especially between 0.3% wt. and less than 0.8% wt. on another layer connector (e-c).

The amount wt. of a further layer connector (e-c) is preferably equal to or less than the amount wt. of polymer P (e-b), determined as the solid content of polymer P (e-b) and as the solid content of another layer connector (e-c), in a spray solution or spray suspension preferably equal to or less than half the amount wt. of polymer P (e-b), particularly preferable at equal to or less than one third of the amount wt. of polymer P (e-b) and very particularly preferable at equal to or less than one quarter of the amount wt. of polymer P (e-b).

The spray solution or spray suspension preferably does not contain any further layer connector (e-c) which is a cationic starch. The spray solution or spray suspension preferably contains no further layer connector (e-c) which is a starch. The spray solution or spray suspension preferably contains no further layer connector (e-c) which is purely cationic. The spray solution or spray suspension very highly preferably contains no further layer connector (e-c) which is cationic. The spray solution or spray suspension particularly preferably contains no further layer connector (e-c) which is an organic polymer and is different from polymer P.

The spraying aid (e-d), which is different from a polymer P and the further layer connector, is, for example, a viscosity regulator, a pH regulator, a defoamer or a biocide.

The spray solution or spray suspension preferably contains between 0% wt. and less than 2% wt. of spray aid (e-d) based on the total weight of the spray solution or spray suspension. The amount of spraying aid (e-d) is very preferably between 0.001% wt. and less than 1% wt. of spraying aid (e-d), particularly preferable between 0.005% wt. and less than 0.8% wt. of spraying aid (e-d) and very particularly preferable between 0.01 wt.-% and less than 0.5 wt.-% of spraying aid (e-d).

The amount wt. of a spraying aid (e-d) is preferably equal to or less than the amount wt. of polymer P (e-b), determined as the solid content of polymer P (e-b), in a spray solution or spray suspension preferably equal to or less than a twentieth of the amount wt. of polymer P (e-b), particularly preferable at equal to or less than a thirtieth of the amount wt. of polymer P (e-b) and very particularly preferable at equal to or less than a fortieth of the amount wt. of polymer P (e-b).

The spray solution or spray suspension preferably contains no polydiallyldimethylammonium chloride or pentaethylene hexamine which is substituted with an alkyl having at least 5 C atoms or with an arylalkyl. The spray solution or spray suspension very preferably contains no homopolymer or copolymer of protonated or quaternized dialkylaminoalkyl acrylate, homopolymer or copolymer of protonated or quaternized dialkylaminoalkyl methacrylate, homopolymer or copolymer of protonated or quaternized dialkylaminoalkylacrylamide, homopolymer or copolymer of protonated or quaternized dialkylaminoalkyl amyl acrylated, quaternized or quaternized or quaternized or copolymer of diallyldimethylammonium chloride or pentaethylene hexamine which is substituted by an alkyl having at least 5 C atoms or by an arylalkyl.

The spray solution or spray suspension preferably contains no filler according to the previous definition of the filler (a-d).

The spray solution preferably consists of (e-a) Water (e-b) water soluble polymer P, (e-c) another layer connector, which is different from a polymer P, (e-d) a Spraying aid, wherein the content of water (e-a) is at least 80% wt. based on the weight of the spray solution or spray suspension and the content of spray aid (e-d) is between 0% wt. and below 2% wt. based on the weight of the spray solution or spray suspension.

The applied quantity of spray solution or spray suspension is preferably 0.05 to 5 g/m$^2$ based on the solid content of the spray solution or spray suspension and based on the sprayed area. 0.1 to 3 g/m$^2$, is highly preferred, particularly preferable is 0.3 to 1.5 g/m$^2$, very particularly preferable 0.4 to 1.0 g/m$^2$ and especially preferable between 0.5 to 0.8 g/m$^2$.

Solution, precipitation, suspension or emulsion polymerization are available for polymerizing monomers (i) and (ii) to polymer P. Solution polymerization in aqueous media is preferred. Suitable aqueous media are water and mixtures of water and at least one water-miscible solvent, e.g. B. alcohol. Examples of an alcohol are methanol, ethanol or n-propanol. The polymerization is carried out radically, for example by using radical polymerization initiators, for example peroxides, hydroperoxides, so-called redox catalysts or azo compounds which break down into radicals. The polymerization is carried out, for example, in water or a water-containing mixture as solvent in a temperature range from 30 to 140° C., it being possible to work under ambient pressure, reduced or elevated pressure. A water-soluble polymerization initiator is preferably chosen for the solution polymerization, for example 2,2'-azobis (2-methylpropionamidine) dihydrochloride.

When polymerizing monomers (i) and (ii) to polymer P, polymerization regulators can be added to the reaction. Typically, 0.001 to 5 mol % based on the total amount of all monomers (i) and (ii) are used. Polymerization regulators are known from the literature and, for example, sulphur compounds, sodium hypophosphite, formic acid or tribromochloromethane. Individual examples of sulphur compounds are mercaptoethanol, 2-ethylhexyl thioglycolate, thioglycolic acid and dodecyl mercaptan.

The polymer P preferably has a weight-average molecular weight Mw between 75,000 and 5,000,000 Daltons. The polymer P very preferably has a weight-average molecular weight Mw between 100,000 and 4500,000 Daltons, highly preferable between 180,000 and 2500,000 Daltons and especially preferable between 210,000 and 1500,000 Daltons. The weight average molecular weight can be determined with static light scattering, for example at a pH of 9.0 in a 1000 millimolar saline solution.

The polymer P preferably has a cationic equivalent of less than 3 meq/g, highly preferable less than 2.4 meq/g, particularly preferable less than 2.2 and more than 0.1 meq/g, and especially preferable from 2.0 meq/g to 0.5 meq/g. The cationic equivalent is preferably determined by titration of an aqueous solution of the polymer P, which is adjusted to a pH value of 3, using an aqueous potassium polyvinyl sulphate solution. The cationic equivalent is particularly preferably determined by i) providing a predetermined volume of an aqueous solution of the polymer P, which is set to a pH value of 3, in a particle charge detector, for example the particle charge detector PCD-02 manufactured by the company Mutek, ii) titration of the aqueous solution provided with an aqueous potassium polyvinyl sulphate solution, for example with a concentration of N/400, to the point at which the flow potential is zero, and iii) calculation of the electrical charge.

Examples of monomers (i) of the formula I are N-vinylformamide ($R^1$=H), N-Vinylacetamide ($R^1$=$C_1$-Alkyl), N-Vinylpropionamide ($R^1$=$C_2$-Alkyl) and N-Vinylbutyramide ($R^1$=$C_3$-Alkyl). The $C_3$-$C_6$-Alkyls can be linear or branched. An example of $C_1$-$C_6$-Alkyl is Methyl, Ethyl, n-Propyl, 1-Methylethyl, n-Butyl, 2-Methylpropyl, 3-Methylpropyl, 1,1-Dimethylethyl, n-Pentyl, 2-Methylbutyl, 3-Methylbutyl, 2,2-Dimethylpropyl or n-Hexyl. $R^1$ is preferably H or $C_1$-$C_4$-Alkyl, highly preferable H or $C_1$-$C_2$-Alkyl, especially preferable H or $C_1$-Alkyl and very highly preferable H, i.e. the monomer (i) is N-vinylformamide. With a single monomer of formula, I, this also includes a mixture of different monomers of formula I as monomer (i). The number fraction of the monomer with R1=H in the total number of all monomers (i) of the formula I is preferably at 85 to 100%, very preferable at 90% to 100%, particularly preferable at 95% to 100% and very highly preferable at 99-100%.

The total amount of all monomers (i) is preferably 45 to 85 mol % based on all monomers polymerized to obtain polymer P, i.e. all monomers (i) and (ii) or according to the following specifications of (ii) consequently (i), (ii-A), (ii-B), (ii-C) and (ii-D) or (i), (ii-1), (ii-2), (ii-3), (ii-4), (ii-5), (ii-6), (ii-7) and (ii-8), very much preferable at 50 to 83 mol %, particularly preferable at 55 to 82 mol %, very particularly preferable at 60 to 81 mol % and specially preferable at 62 to 80 mol %.

An ethylenically unsaturated monomer herein is a monomer containing at least one $C_2$—Unit, whose two carbon atoms are linked by a carbon-carbon double bond. In the case of hydrogen atoms as the only substitute, this is ethylene. In the case of substitution with 3 hydrogen atoms, a vinyl derivative is present. In the case of substitution with two hydrogen atoms, an E/Z isomer or an ethene-1.1-diyl derivative is present. Monoethylenically unsaturated monomer means here that exactly one $C_2$-Unit is present in the monomer.

The total amount of all monomers (i) is preferably 15 to 55 mol % based on all monomers polymerized to obtain polymer P, i.e. all monomers (i) and (ii) or according to the following specifications of (ii) consequently (i), (ii-A), (ii-B), (ii-C) and (ii-D) or (i), (ii-1), (ii-2), (ii-3), (ii-4), (ii-5), (ii-6), (ii-7) and (ii-8), very much preferable at 17 to 50 mol %, particularly preferable at 18 to 45 mol %, very particularly preferable at 19 to 40 mol % and specially preferable at 20 to 38 mol %.

By polymerizing monomers of the formula I, the polymer P initially contains amide groups resulting from these monomers. In the case of N-vinylformamide, i.e. Formula I with $R^1$=H, this is the formamide group —NH—C(=O) H. As is known, e.g. in EP 0438744 A1, page 8/lines 26 to 34, the amide group can be hydrolysed acidic or basic with elimination of the carboxylic acid and the formation of a primary amino group in the polymer P. Basic hydrolysis of the amide group is preferred. If all amide groups are not hydrolysed, it is known that the formation of a cyclic, six-membered amidine is possible by condensation of the primary amino group with an adjacent amide group. In this respect, the hydrolysis of an amide group leads to the formation of a primary amino group or an amidine group on the polymer P in accordance with the reaction scheme below.

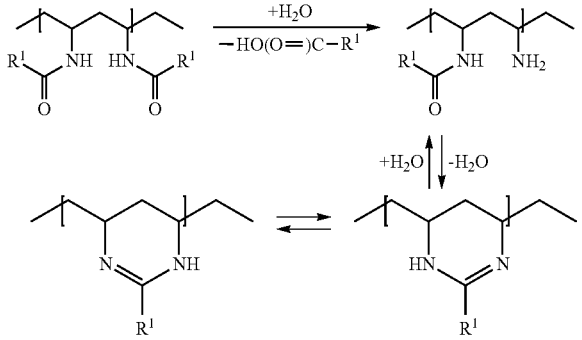

In the case of polymerization of ethylene derivatives substituted directly on the ethylene function with cyan, e.g. Acrylonitrile, the polymer P additionally contains cyano groups. The primary amino group in polymer P formed by hydrolysis is known to react with one of these cyano groups to form a cyclic, 5-membered amidine. In this respect, the hydrolysis of an amide group in this case leads to an amidine group on the polymer P according to the following reaction scheme. In the following reaction scheme, the ethylene derivative substituted with cyan is in polymerized acrylonitrile.

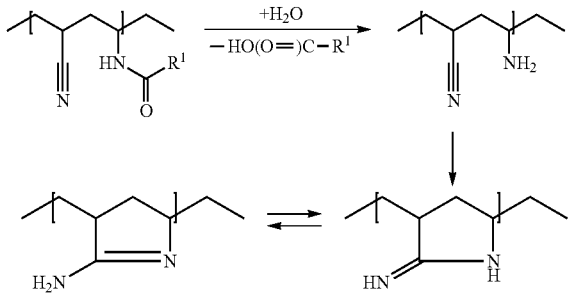

In both cases shown, the hydrolysis of an amide group which originates from a monomer of the formula I leads to a primary amino group or an amidine group. A primary amino group or an amidine group is positively charged at pH=7 and corresponds to a cationic charge in the polymer P.

The conditions for the hydrolysis of the amide groups in the polymer P, which originate from monomers of the formula I, can also lead to the hydrolysis of other groups in the polymer P which are sensitive to hydrolysis under these conditions. As is known, e.g. in EP 0216387 A2, column 6/lines 7 to 43, or in WO 2016/001016 A1, page 17/lines 1 to 8, hydrolyse acetate groups in the polymer P, which originate from vinyl acetate as monomer (ii). Accordingly, a secondary hydroxy group is formed in the polymer P, as shown below.

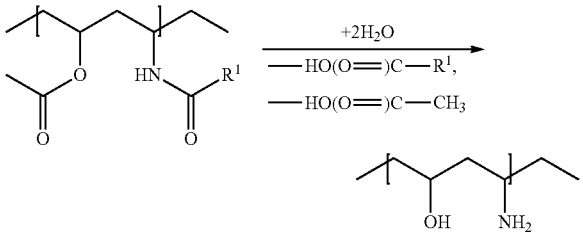

Examples of the one or more ethylenically unsaturated monomers (ii) are (ii-A) an anionic monomer, (ii-B) an uncharged monomer, (ii-C) a cationic monomer and (ii-D) a zwitterionic monomer. An anionic monomer carries at least one negative charge at pH=7, an uncharged monomer carries no charge at pH=7, a cationic monomer carries at least one positive charge at pH=7, and a zwitterionic monomer carries at least one anionic charge at pH=7 and at least one cationic charge. The question of whether an atom or a functional group in a monomer carries a charge at pH=7 can be approximated by considering the behaviour of the atom or the functional group in a comparable molecular environment of a non-monomer. An anionic monomer (ii-A) is preferably acrylic acid, methacrylic acid or their alkali metal, alkaline earth metal or ammonium salts. An uncharged monomer (ii-B) is preferably acrylonitrile, methacrylonitrile or vinyl acetate.

The one or more ethylenically unsaturated monomers (ii) are preferably selected from (ii-A) an anionic monomer,
(ii-B) an uncharged monomer,
(ii-C) a cationic monomer,
(ii-D) 0-10 mol % of a zwitterionic monomer, wherein the total amount of all monomers (i) and (ii-A) to (ii-D) is 100 mol % and mol % relates to the total amount of all monomers (i) and (ii-A) to (ii-D).

The one or more ethylenically unsaturated monomers (ii) are preferably selected from (ii-A) an anionic monomer,
(ii-B) an uncharged monomer,
(ii-C) a cationic monomer,
(ii-D) 0-10 mol % of a zwitterionic monomer, where at least one ethylenically unsaturated monomer is an anionic monomer or an uncharged monomer,
wherein the total amount of all monomers (i) and (ii-A) to (ii-D) is 100 mol % and mol % relates to the total amount of all monomers (i) and (ii-A) to (ii-D).

The one or more ethylenically unsaturated monomers (ii) are preferably selected from (ii-A) an anionic monomer, with at least 50% of all anionic monomers being acrylic acid, methacrylic acid or their alkali metal, alkaline earth metal or ammonium salts based on the total number of anionic monomers,
(ii-B) an uncharged monomer, where at least 50% of all uncharged monomers are vinyl acetate, acrylonitrile or methacrylonitrile based on the total number of all uncharged monomers,
(ii-C) a cationic monomer,
(ii-D) 0 to 10 mol % of a zwitterionic monomer, where at least one ethylenically unsaturated monomer is an anionic monomer or an uncharged monomer, wherein the total amount of all monomers (i) and (ii-A) to (ii-D) is 100 mol % and mol % relates to the total amount of all monomers (i) and (ii-A) to (ii-D).

The one or more ethylenically unsaturated monomers (ii) are preferably selected from (ii-A) an anionic monomer, with at least 50% of all anionic monomers being acrylic acid, methacrylic acid or their alkali metal, alkaline earth metal or ammonium salts based on the total number of anionic monomers,
(ii-B) an uncharged monomer, where at least 50% of all uncharged monomers are vinyl acetate, acrylonitrile or methacrylonitrile based on the total number of all uncharged monomers,
(ii-C) 0 to 15 mol % of a cationic monomer,
(ii-D) 0 to 10 mol % of a zwitterionic monomer, wherein at least one ethylenically unsaturated monomer is an anionic monomer or an uncharged monomer, and the number of anionic monomers and of uncharged monomers is 15 to 60 mol %,
wherein the total amount of all monomers (i) and (ii-A) to (ii-D) is 100 mol % and mol % relates to the total amount of all monomers (i) and (ii-A) to (ii-D).

The one or more ethylenically unsaturated monomers (ii) are preferably selected from (ii-A) an anionic monomer, with at least 50% of all anionic monomers being acrylic acid, methacrylic acid or their alkali metal, alkaline earth metal or ammonium salts based on the total number of anionic monomers,
(ii-B) an uncharged monomer, where at least 50% of all uncharged monomers are vinyl acetate, acrylonitrile or methacrylonitrile based on the total number of all uncharged monomers, wherein the total amount of all monomers (i), (ii-A) and (ii-B) is 100 mol % and mol % refers to the total amount of all monomers (i), (ii-A) and (ii-B).

The one or more ethylenically unsaturated monomers (ii) are preferably selected from (ii-1) Acrylic acid or methacrylic acid or their alkali metal, alkaline earth metal or ammonium salts, (ii-2) Acrylonitrile or methacrylonitrile, (ii-3) Vinyl acetate, (ii-4) a monoethylenically unsaturated sulfonic acid, a monoethylenically unsaturated phosphonic acid, a monoethylenically unsaturated mono- or diester of phosphoric acid or a monoethylenically unsaturated carboxylic acid with 4 to 8 carbon atoms, which is different from methacrylic acid, or their alkali metal, alkaline earth metal or ammonium salts, (ii-5) a quaternized, monoethylenically unsaturated monomer, a monoethylenically unsaturated monomer which carries at least one secondary or tertiary amino group and whose at least one secondary or tertiary amino group is protonated at pH 7, or a diallyl-substituted amine which has exactly two ethylenic double bonds and is quaternized or at pH 7 is protonated, or its salt form, (ii-6) a monoethylenically unsaturated monomer which carries no charge at pH 7 and which is different from acrylonitrile, methacrylonitrile and vinyl acetate, or an ethylenically unsaturated monomer whose exactly two ethylenic double bonds are conjugated and which carries no charge at pH 7, (ii-7) 0 to 2 mol % a monomer which has at least two ethylenically unsaturated double bonds which are not conjugated, and which is different from a diallyl-substituted amine which has exactly two ethylenic double bonds, (ii-8) 0 to 10 mol % an ethylenically unsaturated monomer other than monomers (i) and (ii-1) to (ii-7), wherein the total amount of all monomers (i) and (ii-1) to (ii-8) is 100 mol % and mol % refers to the total amount of all monomers (i) and (ii-1) to (ii-8).

Monomers (ii-1) and (ii-4) are examples of an anionic monomer (ii-A). Monomers (ii-2), (ii-3) and (ii-6) are examples of an uncharged monomer (ii-B). The monomers (ii-5) are examples of a cationic monomer (ii-C). The monomers (ii-5) are examples of a cationic monomer (ii-C). Monomers (ii-8) can be an example of a zwitterionic monomer (ii-D).

Alkali metal, alkaline earth metal or ammonium salts have, for example, sodium ions, potassium ions, magnesium ions, calcium ions or ammonium ions as cations. Accordingly, alkali metal or alkaline earth metal bases, ammonia, amines or alkanolamines have been used to neutralize the free acids. For example, sodium hydroxide solution, potassium hydroxide solution, soda, potash, sodium hydrogen carbonate, magnesium oxide, calcium hydroxide, calcium oxide, triethanolamine, ethanolamine, morpholine, diethylene triamine or tetraethylene pentamine have been used. Alkali metal and ammonium salts are preferred, highly preferred are sodium, potassium or (NH4)+salts.

In the case of the monomers (ii-4), a monomer which simultaneously carries a group which is protonated at pH 7 or carries a quaternized nitrogen is not included.

For the monomers (ii-4), monoethylenically unsaturated sulfonic acids are, for example, vinyl sulfonic acid, acrylamido-2-methylpropanesulphonic acid, allylsulphonic acid, methallysulfonic acid, sulphoethylacrylate, sulphoethyl methacrylate, sulphopropylacrylate, sulphopropyl methacrylate, 2-hydroxy-3-methacryloxyrylsulfonic acid or styrene sulphonic acid.

For the monomers (ii-4), monoethylenically unsaturated phosphonic acids are, for example, vinylphosphonic acid, vinylphosphonic acid monomethyl ester, allylphosphonic acid, allylphosphonic acid monomethyl ester, acrylamidomethylpropylphosphonic acid or acrylamidomethylenephosphonic acid.

For the monomers (ii-4), monoethylenically unsaturated mono- or diesters of phosphoric acid are, for example, monoallyl phosphoric acid esters, methacrylethylene glycol phosphoric acid or methacrylethylene glycol phosphoric acid.

For the monomers (ii-4) are monoethylenically unsaturated carboxylic acids with 4 to 8 carbon atoms, which are different from methacrylic acid, for example dimethacrylic acid, ethacrylic acid, maleic acid, fumaric acid, itaconic acid, mesaconic acid, citraconic acid, methylene malonic acid, allylacetic acid, vinyl acetic acid or crotonic acid.

In the case of the monomers (ii-5), a monomer which simultaneously carries a group which is deprotonated at pH 7 is not included. In the case of a monomer (ii-5), salt form means that a corresponding anion ensures charge neutrality in the case of a quaternized nitrogen or in the case of a protonation. Such anions are, for example, chloride, bromide, hydrogen sulphate, sulphate, hydrogen phosphate, methyl sulphate, acetate or formate. Chloride and hydrogen sulphate are preferred, and chloride is particularly preferred.

For the monomers (ii-5), quaternized, monoethylenically unsaturated monomers are, for example [2-(Acryloyloxy) ethyl]trimethylammoniumchloride, [2-(Methacryloyloxy) ethyl]trimethylammoniumchloride, [3-(Acryloyloxy)propyl]trimethylammoniumchloride, [3-(Methacryloyloxy) propyl]trimethylammoniumchloride, 3-(Acrylamidopropyl) trimethylammoniumchloride or 3-(Methacrylamidopropyl) trimethylammoniumchloride. Preferred quaternizing agents used are dimethyl sulphate, diethyl sulphate, methyl chloride, ethyl chloride or benzyl chloride. Methyl chloride is particularly preferred.

For the monomers (ii-5), monoethylenically unsaturated monomers which carry at least one secondary or tertiary amino group and whose at least one secondary or tertiary amino group is protonated at pH 7, for example esters of α, β-ethylenically unsaturated monocarboxylic acids with amino alcohols, mono- and diesters of α, β-ethylenically unsaturated dicarboxylic acids with amino alcohols, amides of α, β-ethylenically unsaturated monocarboxylic acids with dialkylated diamines, vinylimidazole or alkylvinylimidazole.

In the esters of α, β-ethylenically unsaturated monocarboxylic acids with amino alcohols, the acid component is preferably acrylic acid or methacrylic acid. The amino alcohols, preferably C2-C12 amino alcohols, can be C1-C8-mono- or C1-C8-dialkylated on the amine nitrogen. Examples are dialkylaminoethyl acrylates, dialkylaminoethyl methacrylates, dialkylaminopropyl acrylates or dialkylaminopropyl methacrylates. Individual examples are N-methylaminoethyl acrylate, N-methylaminoethyl methacrylate, N, N-dimethylaminoethyl acrylate, N, N-dimethylaminoethyl methacrylate, N, N-diethylaminoethyl acrylate, N, N-diethylaminoethyl methacrylate, N, N-dimethylaminopropyl acrylate, N, N-dimethacrylate-Diethylaminopropyl acrylate, N, N-diethylaminopropyl methacrylate, N, N-dimethylaminocyclohexyl acrylate or N, N-dimethylaminocyclohexyl methacrylate.

In the mono- and diesters of α, β-ethylenically unsaturated dicarboxylic acids with amino alcohols, the acid component is preferably fumaric acid, maleic acid, monobutyl maleate, itaconic acid or crotonic acid. The amino alcohols, preferably C2-C12 amino alcohols, can be C1-C8-mono- or C1-C8-dialkylated on the amine nitrogen.

Amides of α, β-ethylenically unsaturated monocarboxylic acids with dialkylated diamines are, for example, dialkylaminoethyl acrylamides, dialkylaminoethyl methacrylamides, dialkylaminopropylacrylamides or dialkylaminopropylacrylamides. Individual examples are N-[2-(dimethylamino) ethyl] acrylamide, N-[2-(dimethylamino) ethyl] methacrylamide, N-[3-(dimethylamino) propyl] acrylamide, N-[3-(dimethylamino) propyl] methacrylamide, N-[4-(dimethylamino) butyl] acrylamide, N-[4-(dimethylamino) butyl] methacrylamide, N-[2-(diethylamino) ethyl] acrylamide or N-[2-(diethylamino) ethyl] methacrylamide.

For the monomers (ii-5), diallyl-substituted amines which have exactly two ethylenic double bonds and are quaternized or protonated at pH 7 are, for example, diallylamine or diallyldimethylammonium chloride.

Examples of the monomers (ii-6) are monoesters of α, β-ethylenically unsaturated monocarboxylic acids with $C_1$-$C_{30}$ alkanols, monoesters of α, β-ethylenically unsaturated monocarboxylic acids with $C_2$-$C_{30}$ alkanediols, diesters of α, β-ethylenically unsaturated Dicarboxylic acids with $C_1$-$C_{30}$ alkanols or $C_2$-$C_{30}$ alkanediols, primary amides of α, β-ethylenically unsaturated monocarboxylic acids, N-alkylamides of α, β-ethylenically unsaturated monocarboxylic acids, N, N-dialkylamides of α, β-ethylenically unsaturated monocarboxylic acids, Nitriles of α, β-ethylenically unsaturated monocarboxylic acids other than acrylonitrile and methacrylonitrile, dinitriles of α, β-ethylenically unsaturated dicarboxylic acids, esters of vinyl alcohol with $C_1$- or $C_3$-$C_{30}$-monocarboxylic acids, esters of allyl alcohol with $C_1$-$C_{30}$-Monocarboxylic acids, N-vinyl lactams, nitrogen-free heterocycles with an α, β-ethylenically unsaturated double bond, vinyl aromatics, vinyl halides, vinylidene halides, $C_2$-$C_8$ monoolefins or $C_4$-$C_{10}$ olefins with exactly two double bonds that are conjugated.

Monoesters of α, β-ethylenically unsaturated monocarboxylic acids with C1-C30-alkanols are, for example, methyl acrylate, methyl methacrylate, methyl ethacrylate (=methyl 2-ethyl acrylate), ethyl acrylate, ethyl methacrylate, ethyl acrylate (=ethyl 2-ethyl acrylate), n-butyl acrylate, n-butyl methacrylate, isobutyl acrylate, isobutyl methacrylate, tert-butyl acrylate, tert-butyl methacrylate, tert-butyl ethacrylate, n-octylacrylate, n-octyl methacrylate, 1,1,3,3-tetramethylbutyl acrylate, 1,1,3,3-tetramethyl-butyl methacrylate or 2-ethylhexyl acrylate.

Monoesters of α, β-ethylenically unsaturated monocarboxylic acids with C2-C30-alkanediols are, for example, 2-hydroxyethyl acrylate, 2-hydroxyethyl methacrylate, 2-hydroxyethyl ethacrylate, 2-hydroxypropyl acrylate, 2-hydroxypropyl methacrylate, 3-hydroxypropyl acrylate, 3-hydroxypropyl methacrylate, 3-hydroxybutyll acrylate, 3-hydroxybutyl methacrylate, 4-hydroxybutyl acrylate, 4-hydroxybutyl methacrylate, 6-hydroxyhexyl acrylate or 6-hydroxyhexyl methacrylate.

Primary amides of α, β-ethylenically unsaturated monocarboxylic acids are, for example, acrylic acid amide or methacrylic acid amide.

N-alkyl amides of α, β-ethylenically unsaturated monocarboxylic acids are, for example, N-methyl acrylamide, N-methyl methacrylamide, N-isopropylacrylamide, N-isopropyl methacrylamide, N-ethyl acrylamide, N-ethyl methacrylamide, N-(n-propyl) acrylamide, N-(n-propyl) methacrylamide, N-(n-butyl acrylamide, N-(n-butyl) methacrylamide, N-(tert-butyl) acrylamide, N-(tert-butyl) methacrylamide, N-(n-octyl) acrylamide, N-(n-octyl) methacrylamide, N-(1,1,3,3-tetramethylbutyl) acrylamide, N-(1,1,3,3-tetramethylbutyl) methacrylamide, N-(2-ethylhexyl) acrylamide or N-(2-Ethylhexylmethacrylamid.

Examples of N, N-dialkylamides of α, β-ethylenically unsaturated monocarboxylic acids are N, N-dimethylacrylamide or N, N-dimethylmethacrylamide.

Esters of vinyl alcohol with $C_1$ or $C_3$-$C_{30}$ monocarboxylic acids are, for example, vinyl formate or vinyl propionate.

Examples of N-vinyllactams are N-vinylpyrrolidone, N-vinylpiperidone, N-vinylcaprolactam, N-vinyl-5-methyl-2-pyrrolidone, N-vinyl-5-ethyl-2-pyrrolidone, N-vinyl-6-methyl-2-piperidone, N-vinyl-6-ethyl-2-piperidone, N-vinyl-7-methyl-2-caprolactam or N-vinyl-7-ethyl-2-caprolactam.

Examples of vinyl aromatics are styrene or methylstyrene.

Vinyl halides are, for example, vinyl chloride or vinyl fluoride.

Vinylidene halides are, for example, vinylidene chloride or vinylidene fluoride.

$C_2$-$C_8$-monoolefins are, for example, ethylene, propylene, isobutylene, 1-butene, 1-hexene or 1-octene.

$C_4$-$C_{10}$-olefins with exactly two double bonds that are conjugated are, for example, butadiene or isoprene.

The monomers (ii-7) act as crosslinkers. Examples of the monomers (ii-7) are triallylamine, methylenebisacrylamide, glycol diacrylate, glycol dimethacrylate, glycerol triacrylate, pentaerythritol triallyl ether, N, N-divinylethylene urea, tetraallylammonium chloride, polyalkylene glycol sorbate or at least twice esterified with acrylic acid and/or methacrylic acid, or methacrylic acid such as pentalkylene glycol.

Examples of monomers (ii-8) are the sulfobetaine 3-(dimethyl (methacryloylethyl) ammonium) propanesulfonate, the sulfobetaine 3-(2-methyl-5-vinylpyridinium) propanesulfonate, the carboxybetaine N-3-methacrylamidopropyl-N, N-dimethyl-beta-ammonium propionate, the carboxybetaine N-2-acrylamidoethyl-N, N-dimethyl-beta-ammonium propionate, 3-vinylimidazole-N-oxide, 2-vinylpyridine-N-oxide or 4-vinylpyridine-N-oxide, A polymer P which is obtainable by polymerizing is preferred (i) 50 to 85 mol % of a monomer of Formula I, (ii) 15 to 50 mol % of one or more ethylenically unsaturated monomers which are different from a monomer of the Formula I, where among the monomers (ii)

(ii-2) Contains 0 to 35 mol % Acrylonitrile or methacrylonitrile, and optionally by a subsequent partial or complete hydrolysis of the units of the monomers (i) polymerized into the polymer P.

The content of the monomers (ii-2) in mol % relates to the total number of all monomers (i) and (ii), i.e. all monomers used in the polymerization. The total number of all monomers is 100 mol %. Depending on the chosen hydrolysis conditions of the polymer P, cyan or nitrile groups of the polymerized monomers (ii-2) can also be partially hydrolysed to carboxamide or carboxylic acid groups. In the case of hydrolysis, a cyan or nitrile group can also react with a polymerized monomer (i) to form a cyclic, 5-membered amidine. 0 to 34 mol % of the monomers (ii-2) is highly preferred, particularly between 0.1 to 34 mol % and highly preferable at 1 to 27 mol %.

A polymer P which is obtainable by polymerizing is preferred (i) 50 to 85 mol % of a monomer of Formula I, (ii) 15 to 50 mol % of one or more ethylenically unsaturated monomers which are different from a monomer of the Formula I, where among the monomers (ii)

(ii-3) 0 to 35 mol % Vinyl acetate are included and optionally by a subsequent partial or complete hydrolysis of the units of the monomers (i) polymerized into the polymer P.

The content of the monomers (ii-3) in mol % relates to the total number of all monomers (i) and (ii), i.e. all monomers used in the polymerization. The total number of all monomers is 100 mol %. In the case of hydrolysis, the acetate groups of the copolymerized monomers (ii-3) can partially or completely hydrolyse to secondary hydroxyl groups. 0 to 34 mol % of the monomers (ii-3) is highly preferred, particularly between 0.1 to 34 mol % and highly preferable at 1 to 27 mol %.

A polymer P which is obtainable by polymerizing is preferred (i) 50 to 85 mol % of a monomer of Formula I, (ii) 15 to 50 mol % of one or more ethylenically unsaturated monomers which are different from a monomer of the Formula I, where among the monomers (ii)

(ii-4) contains 0 to 10 mol % of monoethylenically unsaturated sulfonic acid, a monoethylenically unsaturated phosphonic acid, a monoethylenically unsaturated mono- or diester of phosphoric acid or a monoethylenically unsaturated carboxylic acid with 4 to 8 C atoms, which is different from methacrylic acid, or its alkali metal, alkaline earth metal or ammonium salts.

and optionally by a subsequent partial or complete hydrolysis of the units of the monomers (i) polymerized into the polymer P.

The content of the monomers (ii-4) in mol % relates to the total number of all monomers (i) and (ii), i.e. all monomers used in the polymerization. The total number of all monomers is 100 mol %. 0 to 5 mol % of the monomers (ii-4) is highly preferred, particularly between 0.1 to 5 mol % and highly preferable at 1 to 3 mol %.

A polymer P which is obtainable by polymerizing is preferred (i) 50 to 85 mol % of a monomer of Formula I, (ii) 15 to 50 mol % of one or more ethylenically unsaturated monomers which are different from a monomer of the Formula I, where among the monomers (ii)

(ii-5) contains 0 to 20 mol % of quaternized, monoethylenically unsaturated monomer, a monoethylenically unsaturated monomer which carries at least one secondary or tertiary amino group and whose at least one secondary or tertiary amino group is protonated at pH 7, or a diallyl-substituted amine which has exactly two ethylenic double bonds and is quaternized or at pH 7 is protonated, or its salt form, and optionally by a subsequent partial or complete hydrolysis of the units of the monomers (i) polymerized into the polymer P.

The content of the monomers (ii-5) in mol % relates to the total number of all monomers (i) and (ii), i.e. all monomers used in the polymerization. The total number of all monomers is 100 mol %. 0 to 34 mol % of the monomers (ii-5) is highly preferred, particularly between 0.1 to 34 mol % and highly preferable at 1 to 27 mol %.

A polymer P which is obtainable by polymerizing is preferred (i) 50 to 85 mol % of a monomer of Formula I, (ii) 15 to 50 mol % of one or more ethylenically unsaturated monomers which are different from a monomer of the Formula I, where among the monomers (ii)

(ii-6) contains 0 to 35 mol % of monoethylenically unsaturated monomer that does not carry a charge at pH 7 and is different from acrylonitrile, methacrylonitrile and vinyl acetate, or an ethylenically unsaturated monomer whose exactly two double bonds are conjugated that carries no charge at pH 7 and that is different from acrylonitrile, methacrylonitrile and vinyl acetate, and optionally by a subsequent partial or complete hydrolysis of the units of the monomers (i) polymerized into the polymer P.

The content of the monomers (ii-6) in mol % relates to the total number of all monomers (i) and (ii), i.e. all monomers used in the polymerization. The total number of all monomers is 100 mol %. 0 to 34 mol % of the monomers (ii-6) is highly preferred, particularly between 0.1 to 34 mol % and highly preferable at 1 to 27 mol %.

A polymer P is preferred, in the polymerization of which less than 5 mol % of acrylamides is used as monomer (ii), very preferably less than 1 mol % of acrylamide and particularly preferably no acrylamide is used.

A polymer P which is obtainable by polymerizing is preferred (i) 50 to 85 mol % of a monomer of Formula I, (ii) 15 to 50 mol % of one or more ethylenically unsaturated monomers which are different from a monomer of the Formula I, where among the monomers (ii)

(ii-7) contains 0 to 1 mol % of a monomer which has at least two ethylenically unsaturated double bonds which are not conjugated, and which is different from a diallyl-substituted amine which has exactly two ethylenic double bonds, and optionally by a subsequent partial or complete hydrolysis of the units of the monomers (i) polymerized into the polymer P.

The content of the monomers (ii-7) in mol % relates to the total number of all monomers (i) and (ii), i.e. all monomers used in the polymerization. The total number of all monomers is 100 mol %. 0 to 0.5 mol % of the monomers (ii-7) is highly preferred, particularly between 0.001 to 0.5 mol % and highly preferable at 0.01 to 0.1 mol %.

A polymer P which is obtainable by polymerizing is preferred (i) 50 to 85 mol % of a monomer of Formula I, (ii) 15 to 50 mol % of one or more ethylenically unsaturated monomers which are different from a monomer of the Formula I, where among the monomers (ii)?

(ii-8) contains 0 to 5 mol % of ethylenically unsaturated monomer different from monomers (i) and (ii-1) to (ii-7)

and optionally by a subsequent partial or complete hydrolysis of the units of the monomers (i) polymerized into the polymer P.

The content of the monomers (ii-7) in mol % relates to the total number of all monomers (i) and (ii), i.e. all monomers used in the polymerization. The total number of all monomers is 100 mol %. 0 to 3 mol % of the monomers (ii-8) is highly preferred, particularly between 0.1 to 3 mol % and highly preferable at 1 to 2 mol %.

A polymer P which is obtainable by polymerizing is preferred 50 to 85 mol % of a monomer of Formula I (ii-1) 15 to 50 mol % Acrylic acid or methacrylic acid or their alkali metal, alkaline earth metal or ammonium salts, (ii-2) 0 to 35 mol % Acrylonitrile or methacrylonitrile, (ii-3) 0 to 35 mol % Vinyl acetate, (ii-4) 0 to 35 mol % of monoethylenically unsaturated sulfonic acid, a monoethylenically unsaturated phosphonic acid, a monoethylenically unsaturated mono- or diester of phosphoric acid or a monoethylenically unsaturated carboxylic acid with 4 to 8 C atoms, which is different from methacrylic acid, or its alkali metal, alkaline earth metal or ammonium salts.

(ii-5) 0 to 35 mol % of quaternized, monoethylenically unsaturated monomer, a monoethylenically unsaturated monomer which carries at least one secondary or tertiary amino group and whose at least one secondary or tertiary amino group is protonated at pH 7, or a diallyl-substituted amine which has exactly two ethylenic double bonds and is quaternized or at pH 7 is protonated, or its salt form, (ii-6) 0 to 35 mol % of monoethylenically unsaturated monomer that does not carry a charge at pH 7 and is different from acrylonitrile, methacrylonitrile and vinyl acetate, or an ethylenically unsaturated monomer whose exactly two ethylenic double bonds are conjugated and that carries no charge at pH 7, (ii-7) 0 to 2 mol % a monomer which has at least two ethylenically unsaturated double bonds which are not conjugated, and which is different from a diallyl-substituted amine which has exactly two ethylenic double bonds, (ii-8) 0 to 10 mol % of ethylenically unsaturated monomer which is different than monomers (ii-1) to (ii-7), and optionally by subsequently partially or completely hydrolysing the units of the monomers of the formula (I) polymerized into the polymer P to form primary amino groups or amidine groups, the ester group being partially or fully hydrolysed by vinyl acetate polymerized in, the total amount of all monomers (i) and (ii-1) to (ii-8) is 100 mol % and mol % relates to the total amount of all monomers (i) and (ii-1) to (ii-8). A quantity of (i) from 50 to 83 mol % and of (ii-1) from 17 to 50 mol % is highly preferred. A content of (i) from 55 to 82 mol % and of (ii-1) from 18 to 45 mol % is specially preferred. A content of (i) from 60 to 81 mol % and of (ii-1) from 19 to 40 mol % is very particularly preferred. A content of (i) from 62 to 80 mol % and of (ii-1) from 20 to 38 mol % is specially preferred.

A polymer P which is obtainable by polymerizing is preferred 50 to 85 mol % of a monomer of Formula I (ii-1) 15 to 50 mol % Acrylic acid or methacrylic acid or their alkali metal, alkaline earth metal or ammonium salts, (ii-2) 0 to 35 mol % Acrylonitrile or methacrylonitrile, (ii-3) 0 to 35 mol % Vinyl acetate, and optionally by subsequently partially or completely hydrolysing the units of the monomers of the formula (I) polymerized into the polymer P to form primary amino groups or amidine groups, the ester group being partially or fully hydrolysed by vinyl acetate polymerized in, the total amount of all monomers (i), (ii-1), (ii-2) and (ii-3) is 100 mol % and mol % relates to the total amount of all monomers (i), (ii-1), (ii-2) and (ii-3). A content of (i) from 50 to 83 mol % and of (ii-1) from 17 to 50 mol % is highly preferred. A content of (i) from 55 to 82 mol % and of (ii-1) from 18 to 45 mol % is specially preferred. A content of (i) from 60 to 81 mol % and of (ii-1) from 19 to 40 mol % is very particularly preferred. A content of (i) from 62 to 80 mol % and of (ii-1) from 20 to 38 mol % is specially preferred.

A polymer P which is obtainable by polymerizing is preferred 50 to 85 mol % of a monomer of Formula I (ii-1) 15 to 50 mol % Acrylic acid or methacrylic acid or their alkali metal, alkaline earth metal or ammonium salts, (ii-2) 0 to 35 mol % Acrylonitrile or methacrylonitrile, and optionally by subsequent partial or complete hydrolysis of the units of the monomers of the formula (I) polymerized into the polymer P to form primary amino groups or amidine groups, the total amount of all monomers (i), (ii-1) and (ii-2) is 100 mol % and mol % relates to the total amount of all monomers (i), (ii-1) and (ii-2). A content of (i) from 50 to 83 mol % and of (ii-1) from 17 to 50 mol % is highly preferred. A content of (i) from 55 to 82 mol % and of (ii-1) from 18 to 45 mol % is specially preferred. A content of (i) from 60 to 81 mol % and of (ii-1) from 19 to 40 mol % is very particularly preferred. A content of (i) from 62 to 80 mol % and of (ii-1) from 20 to 38 mol % is specially preferred.

The procedure is preferably carried out in a paper machine.

For a single-layer paper, the paper machine preferably has equipment which comprises of a first sieve section with the first sieve, which has a first sieve top side and a first sieve underside, a press section, a spray device containing the spray solution or spray suspension and a dryer section with heated cylinders, and in the paper machine, these are arranged in the order of the first sieve section, followed by the press section, followed by the spraying device and then the drying section. The spray device is preferably located at the end of the press section. In the paper machine, step (A) takes place in the first sieve section, step (D-1) takes place in the press section, step (E-1) at the end of the press section or between press section and dryer section and step (F-1) takes place in the dryer section.

For a multi-layer paper, the paper machine preferably has equipment which has a first sieve section with the first sieve, which has a first sieve top side and a first sieve bottom, a second sieve section with the second sieve, which has a second sieve top and a second sieve bottom, a press section, a spray device containing the spray solution or spray suspension and a dryer section with heated cylinders, and these are arranged in the paper machine in the sequence first sieve section and second sieve section, followed by the press section, followed by the spray device and then the dryer section. The spray device is preferably located at the end of the press section. In the paper machine, step (A) takes place in the first sieve section, step (B) takes place in the second sieve section, step (C) takes place before the press section, preferably at the end of the first sieve section and the second sieve section, step (D-2) takes place in the press section, step (E-2) at the end of the press section or between press section and dryer section and step (F-2) takes place in the dryer section.

The spray device preferably comprises of at least one nozzle, very preferably one or more nozzles, which make it possible to spray the spray solution or spray suspension under an overpressure of 0.5 to 4.5 bar compared to the ambient pressure.

The first pulp suspension for a single-layer paper passes through the paper machine with dehydration on a sieve, dehydration by pressing, spraying on at least one surface side and dehydration by supplying heat to a single-layer paper in the direction from the sieve section to the dryer section.

The first fibrous suspension and the second fibrous pulp suspension for a multi-layer paper pass through the paper machine under drainage on a sieve, assembly, dehydration by pressing, spraying on at least one flat side and dehydration by supplying heat to a multi-layer paper in the direction from the sieve sections to the dryer section.

The preferences for the process for producing single-layer or multi-layer paper applies to the other objects of the invention.

Another object of the invention is a dried single-layer paper which is obtainable by a process to produce dried single-layer paper comprising the steps (A) Dehydrating a first aqueous fibre suspension, which has a dry matter content between 0.1 wt. % And 6 wt. %, on a first sieve, whereby a first fibrous web, which has a dry matter content between 14 wt. % and 25 wt.-%, arises, (D-1) Dehydrating the first fibrous web by pressing, thereby creating a partially dehydrated first fibrous web, (E-1) Spraying the partially dehydrated first fibrous web on at least one surface side with a spray solution or spray suspension, which results in a sprayed partially dehydrated first fibrous web, (F-1) Dehydrating the sprayed partially dehydrated first fibrous web by applying heat to form the dried single-layer paper, wherein the spray solution or spray suspension contains (e-a) Water (e-b) at least one water-soluble polymer P, which can be obtained by polymerizing (i) 40 to 85 mol % of a monomer of Formula I

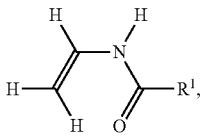

(I)

in which $R^1$=H or $C_1$-$C_6$-Alkyl, (ii) 15 to 60 mol % of one or more ethylenically unsaturated monomers which are different from a monomer of the Formula I, wherein the total amount of all monomers (i) and (ii) is 100 mol %, and optionally by subsequent partial or complete hydrolysis of the units of the monomers of the formula (I) polymerized into the polymer P to form primary amino or amidine groups, wherein the proportion of water is at least 75% wt., based on the spray solution or the spray suspension.

The dried single-layer paper is preferably obtainable from a process in which the spray solution or spray suspension has a pH of 5.5 or greater.

The dry content is preferably determined by drying at 105° C. to constant mass.

The dried single-layer paper has a dry content of preferably at least 88% wt.

The dried single-layer paper preferably has an internal strength of 180 to 500 J/m$^2$, highly preferable from 200 to 430 J/m$^2$, particularly preferable from 210 to 400 J/m$^2$ and specially preferable from 230 to 380 J/m$^2$, wherein the internal strength corresponds to that of the Tappi regulation T833 pm-94.

Another object of the invention is a dried multi-layer paper which is obtainable by a process to produce dried multi-layer paper comprising the steps (A) Dehydrating a first aqueous fibre suspension, which has a dry matter content between 0.1 wt. % And 6 wt. %, on a first sieve, whereby a first fibrous web, which has a dry matter content between 14 wt. % and 25 wt.-%, arises, (A) Dehydrating a second aqueous fibre suspension, which has a dry matter content between 0.1 wt. % And 6 wt. %, on a second sieve, whereby a second fibrous web, which has a dry matter content between 14 wt. % and 25 wt.-%, arises, (C) Assembling the first fibrous web to the second fibrous web such that the two fibrous webs touch each other on an entire surface side, thereby resulting in a layer compound, (D-2) Dehydrating the layer compound by pressing, whereby a partially dehydrated layer compound is formed, (E-2) Spraying the partially dehydrated layer compound on at least one surface side with a spray solution or spray suspension, whereby a sprayed layer compound is formed, (F-2) Dehydrating the sprayed layer compound by applying heat results in the dried multi-layer paper, wherein the spray solution or spray suspension contains (e-a) Water (e-b) at least one water-soluble polymer P, which can be obtained by polymerizing (i) 40 to 85 mol % of a monomer of Formula I

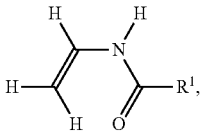

(I)

in which $R^1$=H or $C_1$-$C_6$-Alkyl, (ii) 15 to 60 mol % of one or more ethylenically unsaturated monomers which are different from a monomer of the Formula I, wherein the total amount of all monomers (i) and (ii) is 100 mol %, and optionally by subsequent partial or complete hydrolysis of the units of the monomers of the formula (I) polymerized into the polymer P to form primary amino or amidine groups, wherein the proportion of water is at least 75% wt., based on the spray solution or the spray suspension.

The dried multi-layer paper is preferably obtainable from a process in which the spray solution or spray suspension has a pH of 5.5 or greater.

The dry content is preferably determined by drying at 105° C. to constant mass.

The dried multi-layer paper has a dry content of preferably at least 88% wt.

The dried multi-layer paper is preferably made from two layers, very preferably from one layer with a grammage of 20 to 60 g/m$^2$ and one layer with 60 to 100 g/m$^2$.

The dried multi-layer paper preferably has an internal strength of 180 to 500 J/m$^2$, highly preferable from 200 to 430 J/m$^2$, particularly preferable from 210 to 400 J/m$^2$ and specially preferable from 230 to 380 J/m$^2$, wherein the internal strength corresponds to that of the Tappi regulation T833 pm-94.

Another object of the invention is a paper machine, the equipment of which comprises a first sieve section with a first sieve, which has a first sieve top side and a first sieve underside, a press section, a spraying device and a dryer section with heated cylinders, and in the paper machine these in the order the first sieve section, followed by the press section, followed by the spraying device and then the drying section, the spraying device containing a spray solution or spray suspension, wherein the spray solution or spray suspension contains (e-a) Water (e-b) at least one water-soluble polymer P, which can be obtained by polymerizing (i) 40 to 85 mol % of a monomer of Formula I (I)

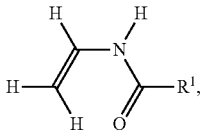

in which $R^1$=H or $C_1$-$C_6$-Alkyl, (ii) 15 to 60 mol % of one or more ethylenically unsaturated monomers which are different from a monomer of the Formula I, wherein the total amount of all monomers (i) and (ii) is 100 mol %, and optionally by subsequent partial or complete hydrolysis of the units of the monomers of the formula (I) polymerized into the polymer P to form primary amino or amidine groups, wherein the proportion of water is at least 75% wt., based on the spray solution or the spray suspension, and the paper machine is suitable for a method of producing dried single-layer paper comprising the steps (A) Dehydrating a first aqueous fibre suspension, which has a dry matter content between 0.1 wt. % And 6 wt. %, on the first sieve, whereby a first fibrous web, which has a dry matter content between 14 wt. % and 25 wt.-%, arises, (D-1) Dehydrating the first fibrous web by pressing, thereby creating a partially dehydrated first fibrous web, (E-1) Spraying the partially dehydrated first fibrous web on at least one flat side with the spray solution or spray suspension from the spraying device, thereby producing a sprayed partially dehydrated first fibrous web, (F-1) Dehydrating the sprayed partially dehydrated first fibrous web by applying heat to form the dried single-layer paper.

A paper machine, whose equipment has a first sieve section with a first sieve, which has a first sieve top side and a first sieve underside, a second sieve section with a second sieve, which has a second sieve top side and a second sieve underside, a press section, a spraying device and one drying section comprising heated cylinders is preferred, and these are arranged in the paper machine in the order of first sieve section and second sieve section, followed by the press section, followed by the spray device and then the dryer section, the spray device containing a spray solution or spray suspension, wherein the spray solution or spray suspension contains (e-a) Water (e-b) at least one water-soluble polymer P, which can be obtained by polymerizing (i) 40 to 85 mol % of a monomer of Formula I (I)

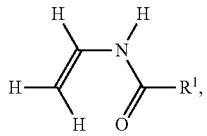

in which $R^1$=H or $C_1$-$C_6$-Alkyl, (ii) 15 to 60 mol % of one or more ethylenically unsaturated monomers which are different from a monomer of the Formula I, wherein the total amount of all monomers (i) and (ii) is 100 mol %, and optionally by subsequent partial or complete hydrolysis of the units of the monomers of the formula (I) polymerized into the polymer P to form primary amino or amidine groups, wherein the proportion of water is at least 75% wt., based on the spray solution or the spray suspension, and the paper machine is suitable for a method of producing dried multi-layer paper comprising the steps (A) Dehydrating a first aqueous fibre suspension, which has a dry matter content between 0.1 wt. % And 6 wt. %, on the first sieve, whereby a first fibrous web, which has a dry matter content between 14 wt. % and 25 wt.-%, arises, (A) Dehydrating a second aqueous fibre suspension, which has a dry matter content between 0.1 wt. % And 6 wt. %, on the second sieve, whereby a second fibrous web, which has a dry matter content between 14 wt. % and 25 wt.-%, arises, (C) Assembling the first fibrous web to the second fibrous web such that the two fibrous webs touch each other on an entire surface side, thereby resulting in a layer compound, (D-2) Dehydrating the layer compound by pressing, whereby a partially dehydrated layer compound is formed, (E-2) Spraying the partially dehydrated layer compound on at least one surface side with the spray solution or spray suspension from the spraying device, whereby a sprayed layer compound is formed, (F-2) Dehydrating the sprayed layer compound by applying heat to form the dried multi-layer paper.

The spray solution or spray suspension in the spray device preferably has a pH of 5.5 or greater.

The dry content is preferably determined by drying at 105° C. to constant mass.

A paper machine which has a device for generating a vacuum on the first underside of the sieve or on the second underside of the sieve is preferred. A paper machine which has a device for generating a vacuum on the first underside of the sieve and a device for generating a vacuum on the second underside of the sieve is highly preferable.

Another invention is a process to produce dried single-layer or multi-layer paper, in which the polymer P there is replaced by a polymer PA compared to the previous process. The objects of this other invention, in addition to the above-mentioned method, are also the corresponding paper obtainable by this method and a paper machine suitable for this method, which contains a spray device containing the aqueous spray solution or spray suspension with polymer PA. The polymer PA which is different than a polymer P is a Michael System modified polymer containing primary amine groups, an alkylated polyvinylamine containing primary amine groups, or a graft polymerization polymer containing primary amine groups.

A Michael system modified polymer containing primary amine groups can be obtained by implementing Michael systems with a starting polymer containing primary amino groups. This application to the polymer type of formula II (II)

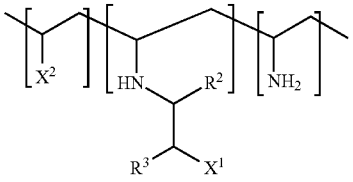

is described in WO 2007/136756.

Michael systems are understood as compounds with an unsaturated double bond which are conjugated to an electron-withdrawing group. Suitable Michael systems are described in Formula III.

(III)

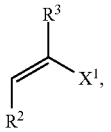

where $R^2$ and $R^3$ remain independent for H, alkyl, alkenyl, carbonyl, carboxyl or carboxamide and X1 remains as an electron-withdrawing group or an electron-withdrawing amine.

Examples of Michael systems are acrylamide, N-alkylacrylamide, methacrylamide, N, N-dimethylacrylamide, N-alkyl methacrylamide, N-(2-methylpropanesulfonic acid acrylamide, N-(glycolic acid) acrylamide, N-[3-(propyl) trimethylammonium chloride] acrylamide, acrylonitrile, methacrylonitrile, Acrolein, methyl acrylate, alkyl acrylate, methyl methacrylate, alkyl methacrylate, aryl acrylate, aryl methacrylate, [2-(methacryloyloxy) ethyl] trimethylammonium chloride, N-[3-(dimethylamino) propyl] methacrylamide, N-ethyl acrylamide, 2-hydroxyethyl acrylate, 3-Sulphopropyl acrylate, 2-hydroxyethyl methacrylate, glycidyl methacrylate, pentafluorophenyl acrylate, ethylene diacrylate, ethylene dimethacrylate, heptafluorobutyl-1-acrylate, poly (methyl methacrylate), acryloylmorpholine, 3-(Acryloyloxy)-2-hydroxypropyl methacrylate, dialkyl ethyl acrylate, dialkyl methyl acrylate, dialkyl ethyl acrylate, 1-adamantyl methacrylate, dimethylaminoneopentyl acrylate, 2-(4-benzoyl-3-hydroxyphenoxy) ethyl acrylate and dimethylaminoethylmethacrylate.

Acrylamide is preferred as the Michael system. The Michael systems are used in an amount of 1 to 75 mol % based on the primary amino groups and/or amidine groups. The reaction conditions for the reaction are described in WO 2007/136756, the disclosure of which is expressly incorporated by reference.

An alkylated polyvinylamine containing primary amine groups is obtained by reactions of the primary amino groups and/or amidine groups of the polyvinylamines. This application is described in WO 2009/017781 as well as reaction conditions. The application products preferably contain structural units selected from the group of polymer units (IV), (V), (VI), (VII) and (VIII)

(IV)

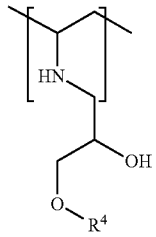

(V)

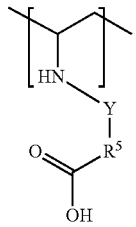

(VI)

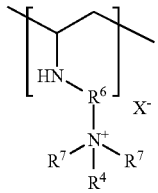

(VII)

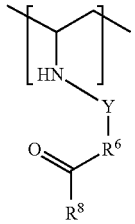

(VIII)

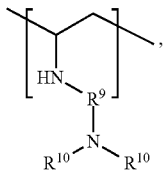

wherein $X^-$ an anion, preferably chloride, bromide or iodide,

Y Carbonyl or methylene or a single bond, $R^4$ Hydrogen, linear or branched $C_1$-$C_{22}$-Alkyl, $R^5$ linear or branched $C_1$-$C_{15}$-Alkylene, or linear or branched $C_1$-$C_{15}$-Alkenylene, $R^6$ linear or branched $C_1$-$C_{12}$-Alkylene, which is optionally substituted with hydroxyl, preferred is —$CH_2CH(OH)CH_2$— or —$CH_2$—$CH_2$—, $R^7$ Hydrogen, linear or branched $C_1$-$C_{22}$-Alkyl, preferably methyl or ethyl, $R^9$ Hydrogen, linear or branched $C_1$-$C_{22}$-Alkyl, linear or branched $C_1$-$C_{22}$-Alkoxy, linear or branched $C_1$-$C_{22}$ Dialkylamine, preferably amino, $R^9$ linear or branched $C_1$-$C_{12}$-Alkylene, preferably —$CH_2$—$CH_2$—, $R^{10}$ Hydrogen, linear or branched $C_1$-$C_{22}$-Alkyl, preferably methyl or ethyl.

Implementation products which contain units of the formula IV can be obtained by polymer-analogous application of the primary amino groups of polyvinylamines with alkylating agents. The alkylation can also be carried out using alkyl glycidyl ethers, glycidol (2,3-epoxy-1-propanol) or chloropropanediol. Preferred alkyl glycidyl ethers are butyl glycidyl ether, 2-ethylhexyl glycidyl ether, hexadecyl glycidyl ether and $C_{12}/C_{14}$ glycidyl ether. The application with alkyl glycidyl ethers is generally carried out in water but can also be carried out in aqueous/organic solvent mixtures.

Implementation products containing units of the formulas V and VII can be obtained by polymer-analogous reaction of the primary amino groups of the polyvinylamines with alkylating agents or acylating agents.

Such alkylating agents are selected from chloroacetic acid, salts of chloroacetic acid, bromoacetic acid, salts of bromoacetic acid, halogen-substituted alkanoic acid acrylamides and halogen-substituted alkenoic acid acrylamides, 3-chloro-2-hydroxypropyltrimethylammonium chloride, 2-(diethylamino) ethylchlorohydrochloride, (dialkylamino) alkylchlorides such as 2-(dimethylamino) ethylchloride, 3-chloro-2-hydroxypropylalkyl-dimethylammonium chlorides such as 3-chloro-2-hydroxypropyllauryldimethylammonium chloride, 3-chloro-2-hydroxypropyl-cocoalkyl-dimethylammonium chloride, 3-chloro-2-hydroxypropylstearyldimethylammonium chloride, (haloalkyl) trimethylammonium chloride such as (4-chlorohexyl) trimethylammonium chloride, (8-chloroctyl) trimethylammonium chloride and glycidylpropyltrimethylammonium chloride.

Such acylating agents are selected from succinic anhydride, substituted succinic anhydrides which are substituted by linear or cross-linked $C_1$-$C_{18}$-Alkyl or linear or cross-linked $C_1$-$C_{18}$-Alkenyl, maleic anhydride, glutaric anhydride, 3-methylglutaric anhydride, 2,2-dimethylsuccinic anhydride cyclic Alkenyl carboxylic anhydrides and alkenyl succinic anhydrides (ASA).

A graft polymerization polymer which contains primary amine groups are, for example, hydrolysed graft polymers of, for example, N-vinylformamide on polyalkylene glycols, polyvinyl acetate, polyvinyl alcohol, polyvinylformamides, polysaccharides such as starch, oligosaccharides or monosaccharides. The graft polymers are obtainable by radically polymerizing, for example, N-vinylformamide in an aqueous medium in the presence of at least one of the graft bases mentioned, if appropriate, together with copolymerizable other monomers, and then hydrolysing the grafted vinylformamide units in a known manner to give copolymerized vinylamine units. Such graft polymers are described, for example, in DE-A-19515943, DE-A-4127733 and DE-A10041211.

EXAMPLES

The percentages in the examples are percentages wt., unless stated otherwise.

A) Additive

A-1) Methods for Characterizing the Polymers

The solids content is determined by distributing 0.5 to 1.5 g of the polymer solution in a metal lid with a diameter of 4 cm and then drying in a forced air-drying cabinet at 140° C. for 120 minutes. The ratio of the mass of the sample after drying under the above conditions to the weighed sample mass multiplied by 100 gives the solids content of the polymer solution in % wt. Drying is carried out at ambient pressure, possibly 101.32 KPa, which is carried out without a correction for a deviation resulting from weather and sea level.

The degree of hydrolysis is the proportion in % of the hydrolysed N—CHO groups of the N-vinylformamide monomers used in the polymerization of the total amount of N-vinylformamide used in the polymerization. The determination of the degree of hydrolysis of the homopolymers or copolymers in which N-vinylformamide is used in the polymerization and which are subjected to hydrolysis is determined by enzymatic analysis of the formic acid or formates released during the hydrolysis (test set from Boehringer Mannheim).

The polymer content indicates the content of polymer without counter ions in the aqueous solution in % wt., i.e. Counter ions are not considered. The polymer content is the sum of the parts wt. of all structural units of the polymer in g, which are present in 100 g of the aqueous solution. It is determined mathematically. For this purpose, potentially charge-bearing structural units are included in the charged form, i.e. e.g. Amino groups in the protonated form and acid groups in the deprotonated form. Counter ions of the charged structural units such as sodium cation, chloride, phosphate, formate, acetate etc. are not considered. The calculation can be carried out in such a way that, for a batch, the application quantity of the monomers, if appropriate a degree of hydrolysis of certain monomers and, optionally a proportion of reactants, the polymer analogue by reaction with the polymer under formation a covalent bond is applied, which determines Structural units of the polymer present at the end of the reaction and these are converted into parts wt. using the molar masses of the structural units.

For this, a complete, i.e. 100% conversion of all monomers used or generally reactants are assumed. The sum of the parts wt. gives the total amount of polymer in this approach. The polymer content results from the ratio of the total amount of polymer to the total mass of the batch. In addition to the total amount of polymer, the total mass of the batch consequently contains reaction medium, optionally cations or anions, and everything added to the reaction batch which is not assumed to be incorporated into the polymer. Substances removed from the reaction mixture (e.g. water which may have been distilled off, etc.) are drawn off.

The total content of primary amino groups and/or amidine groups can be carried out analogously as per the procedure described above for the polymer content. The molar composition is based on the amounts of monomers used, the analytically determined degree of hydrolysis, the ratio of amidine groups to primary amino groups determined by $^{13}$C-NMR-spectroscopy and, if appropriate, the proportion which has been polymer-analogously applied with the polymer to form a covalent bond, the molar composition of the structural units of the polymer present at the end of the reaction. With the help of the molar mass of the individual structural units, the molar proportion of primary amino groups and/or amidine units in meq which is in 1 g of polymer can be calculated. When determined by means of 13C NMR spectroscopy, the area of the formate group HCOO— (173 [ppm]) can be related to the area of the amidine group —N=CH—N— (152 ppm).

The K values are measured according to H. Fikentscher, Cellulosechemie, Vol. 13, 48-64 and 71-74 under the conditions specified in each case. The information in parentheses indicates the concentration of the polymer solution based on the polymer content and the solvent. The measurements were carried out at 25° C. and a pH value of 7.5.

The weight average molecular weight Mw is determined with static light scattering. To do this, the sample is dissolved in a 1000 millimolar saline solution at a pH value of 9.0. The Mw is given in Daltons.

The water used in the examples of polymerizations under A-2) and hydrolysis under A-3) is completely desalinated.

A-2) Polymerisations

Example P-P1: P1 (Polymer VFA=100 Mol %, K-Value 90)

234 g of N-vinylformamide is provided as feed 1.

As feed 2, 1.2 g of 2,2'-azobis (2-methylpropionamidine) dihydrochloride are dissolved in 56.8 g of water at room temperature.

1080.0 g of water and 2.5 g of 75% strength wt. phosphoric acid are placed in a 2 L glass apparatus with anchor stirrer, descending cooler, internal thermometer and nitrogen inlet tube. At a speed of 100 rpm, 2.1 g of a 25% strength wt. sodium hydroxide solution are added, so that a pH of 6.6 is reached. The initial charge is heated to 73° C. and the pressure in the apparatus is reduced to such an extent that the reaction mixture just begins to boil at 73° C. (approx. 350 mbar). Then feeds 1 and 2 are started at the same time. At a constant 73° C., feed 1 is metered in one hour and 15 minutes and feed 2 in 2 hours. After the addition of feed 2 has ended, the reaction mixture is polymerized at 73° C. for a further three hours. About 190 g of water are distilled off during the entire polymerization and post-polymerization. The mixture is then cooled to room temperature under normal pressure.

A slightly yellow, viscous solution is obtained with a solids content of 19.7% wt. and a polymer content of 19.5% wt. The K value of the polymer is 90 (0.5% wt. in water). The Mw is 0.34 million Daltons. The pH Value is expected at 6 to 7 as per the buffer used.

Example P-P2: P2 (Copolymer VFA/Na Acrylate=70 Mol %/30 Mol %, K Value 122)

A mixture of 330 g of water, 217.8 g of aqueous 32% wt. Na-acrylate solution, which is adjusted to pH 6.4, and 124.2 g of N-vinylformamide are provided as feed 1.

As feed 2, 0.3 g of 2,2'-azobis (2-methylpropionamidine) dihydrochloride are dissolved in 66.8 g of water at room temperature.

As feed 3, 0.2 g of 2,2'-azobis (2-methylpropionamidine) dihydrochloride are dissolved in 17.4 g of water at room temperature.

668.3 g of water and 1.9 g of 75% strength wt. phosphoric acid are placed in a 2 L glass apparatus with anchor stirrer, descending cooler, internal thermometer and nitrogen inlet tube. At a speed of 100 rpm, 3.1 g of a 25% wt. strength wt. sodium hydroxide solution are added, so that a pH of 6.6 is reached. The initial charge is heated to 73° C. and the pressure in the apparatus is reduced to approx. 340 mbar, so that the reaction mixture just begins to boil at 73° C. Then feeds 1 and 2 are started at the same time. At a constant 73° C., feed 1 is metered in in two hours and feed 2 in 3 hours. After the addition of feed 2 has ended, the reaction mixture is post-polymerized at 73° C. for a further 2 hours. Then feed 3 is added in 5 minutes and polymerizetion is continued at 73° C. for a further two hours. About 190 g of water are distilled off during the entire polymerization and post-polymerization. The mixture is then cooled to room temperature under normal pressure.

A slightly yellow, viscous solution is obtained with a solids content of 15.9% wt. and a polymer content of 15.6% wt. The K value of the copolymer is 122 (0.1% wt. in 5% wt. aqueous NaCl solution). The Mw is 2.2 million Daltons.

Example P-P3: P3 (Copolymer VFA/Na Acrylate=70 Mol %/30 Mol %, K Value 85)

A mixture of 240.0 g of water, 176.5 g of aqueous 32% Na acrylate solution, which is adjusted to pH 6.4, and 100.6 g of N-vinylformamide are provided as feed 1.

As feed 2, 5.8 g of 2,2'-azobis (2-methylpropionamidine) dihydrochloride are dissolved in 164.2 g of water at room temperature.

As feed 3, 5.8 g of 2,2'-azobis (2-methylpropionamidine) dihydrochloride are dissolved in 164.2 g of water at room temperature.

330 g of water and 1.2 g of 85% wt. phosphoric acid were placed in a 2 L glass apparatus with anchor stirrer, descending cooler, internal thermometer and nitrogen inlet tube. At a speed of 100 rpm, 4.2 g of a 25% wt. strength wt. sodium hydroxide solution are added, so that a pH of 6.6 is reached. The initial charge is heated to 80° C. and the pressure in the apparatus is reduced to approx. 450 mbar, so that the reaction mixture just begins to boil at 80° C. Then feeds 1 and 2 are started simultaneously and metered in synchronously in 2 hours. The mixture is then polymerized at 80° C. for a further one hour. The feed 3 is then added in 5 minutes and the polymerization is continued at 80° C. for a further two hours. About 190 g of water are distilled off during the entire polymerization and post-polymerization. The mixture is then cooled to room temperature under normal pressure.

A slightly yellow, viscous solution is obtained with a solids content of 16.0% wt. and a polymer content of 15.7% wt. The K value of the copolymer is 85 (0.5% wt. in 5% wt. aqueous NaCl). The Mw is 0.8 million Daltons. The pH Value is expected at 6 to 7 as per the buffer used.

Example P-P4: P4 (Copolymer VFA/Na Acrylate=70 Mol %/30 Mol %, K Value 152)

As feed 1, 0.4 g of 2,2'-azobis (2-methylpropionamidine) dihydrochloride are dissolved in 81.2 g of water at room temperature.

As feed 2, 0.6 g of 2,2'-azobis (2-methylpropionamidine) dihydrochloride are dissolved in 104.7 g of water at room temperature.

212 g of water is provided as feed 3.

950 g of water and 1.4 g of 75% strength wt. phosphoric acid are placed in a 2 L glass apparatus with anchor stirrer, descending cooler, internal thermometer and nitrogen inlet tube. At a speed of 100 rpm, 2.5 g of a 25% wt. strength wt. sodium hydroxide solution are added, so that a pH of 6.5 is reached. To this buffer solution 144.7 g of an aqueous 32% wt. Na-acrylate solution, which is adjusted to pH 6.4, and 82.5 g of N-vinylformamide are added. The initial charge is heated to 63° C. and the pressure in the apparatus is reduced to approx. 230 mbar, so that the reaction mixture just begins to boil at 63° C. Then feed 1 is added in 5 minutes. The batch is kept at 63° C. for 3 hours with constant distillation of water. The temperature is then increased to 75° C. and the pressure is set to approximately 390 mbar, so that continuous distillation is still ensured. After 3.5 h, feed 2 is added in 15 min. The temperature is then kept at 75° C. for a further 1.25 h. The feed 3 is then added in 20 min, the vacuum is broken, and the batch is cooled to room temperature. About 270 g of water are distilled off during the polymerization and post-polymerization.

A slightly yellow, viscous solution is obtained with a solids content of 10.2% wt. and a polymer content of 9.9% wt. The K value of the copolymer is 152 (0.1% wt. in 5% wt. aqueous NaCl). The Mw is 4.1 million Daltons.

Example P-P5: P5 (Copolymer VFA/Na Acrylate=60 Mol %/40 Mol %, K Value 90)

A mixture of 423.5 g of aqueous 32% wt. Na acrylate solution, which is adjusted to pH 6.4, and 155.1 g of N-vinylformamide are provided as feed 1.

As feed 2, 2.1 g of 2,2'-azobis (2-methylpropionamidine) dihydrochloride are dissolved in 227.9 g of water at room temperature.

573.4 g of water and 3.0 g of 85% strength wt. phosphoric acid are placed in a 2 L glass apparatus with anchor stirrer, descending cooler, internal thermometer and nitrogen inlet tube. At a speed of 100 rpm, 5.2 g of a 25% wt. sodium hydroxide solution are added so that a pH of 6.6 is reached. The initial charge is heated to 77° C. and the pressure in the apparatus is reduced to approx. 450 mbar, so that the reaction mixture just begins to boil at 77° C. Then feeds 1 and 2 are started at the same time. At a constant 77° C., feed 1 is metered in in 1.5 hours and feed 2 in 2.5 hours. After the addition of feed 2 has ended, the reaction mixture is post-polymerized at 80° C. for a further 2.5 hours. About 200 g of water are distilled off during the entire polymerization and post-polymerization. The mixture is then cooled to room temperature under normal pressure.

A slightly yellow, viscous solution is obtained with a solids content of 25.0% wt. and a polymer content of 24.5% wt. The K value of the copolymer is 90 (0.5% wt. in 5% wt. aqueous NaCl solution). The Mw is 0.9 million Daltons.

Example P-P6: P6 (Copolymer VFA/Na Acrylate=80 Mol %/20 Mol %, K Value 86)

A mixture of 293.7 g of water, 243.0 g of aqueous 32% wt. Na-acrylate solution, which is adjusted to pH 6.4, and 237.2 g of N-vinylformamide are provided as feed 1.

As feed 2, 1.4 g of 2,2'-azobis (2-methylpropionamidine) dihydrochloride are dissolved in 203.6 g of water at room temperature.

659.4 g of water and 3.5 g of 75% strength wt. phosphoric acid are placed in a 2 L glass apparatus with anchor stirrer, descending cooler, internal thermometer and nitrogen inlet tube. At a speed of 100 rpm, 6.0 g of a 25% wt. strength wt. sodium hydroxide solution are added, so that a pH of 6.6 is reached. The initial charge is heated to 80° C. and the pressure in the apparatus is reduced to approx. 460 mbar, so that the reaction mixture just begins to boil at 80° C. Then feeds 1 and 2 are started at the same time. At constant 80° C., feed 1 is metered in in 2 h and feed 2 in 2.5 h. After the addition of feed 2 has ended, the reaction mixture is polymerized at 80° C. for a further 2.5 h. About 170 g of water are distilled off during the entire polymerization and post-polymerization. The mixture is then cooled to room temperature under normal pressure.

A slightly yellow, viscous solution is obtained with a solids content of 21.5% wt. and a polymer content of 21.3% wt. The K value of the copolymer is 86 (0.5% wt. in 5% wt. aqueous NaCl solution). The Mw is 0.7 million Daltons.

A-3) Hydrolysis of polymers containing vinyl formamide in copolymerized form

Example H-H1P1: H1P1 (Polymer VFA [32] from P1)

603.3 g of the polymer solution obtained according to Example P-P1 are mixed in a 1 L four-necked flask with a blade stirrer, internal thermometer, dropping funnel and reflux condenser at a stirrer speed of 80 rpm with 8.6 g of a 40% wt. aqueous sodium bisulfite solution and then on heated to 80° C. Then 94.9 g of a 25% aqueous sodium hydroxide solution is added. The mixture is kept at 80° C. for 3.5 hours. The product obtained is cooled to room temperature and adjusted to pH 3.0 with 31.7 g of 37% strength wt. hydrochloric acid.

A slightly yellow, viscous solution with a polymer content of 14.0% wt. is obtained. The degree of hydrolysis of the polymerized vinylformamide units is 32 mol %.

Example H-H2P1: H2P1 (Polymer VFA[100] from P1)

300.0 g of the polymer solution obtained according to Example P-P1 are mixed in a 1 L four-necked flask with a blade stirrer, internal thermometer, dropping funnel and reflux condenser at a stirrer speed of 80 rpm then heated to 80° C. Then 157.3 g of a 25% wt. aqueous sodium hydroxide solution is added. The mixture is kept at 80° C. for 3 hours. The product obtained is cooled to room temperature and adjusted to pH 7 with 37% hydrochloric acid.

A slightly yellow, viscous solution with a polymer content of 7.2% wt. is obtained. The degree of hydrolysis of the vinylformamide units is 100 mol %.

Example H-H3P2: H3P2 (Copolymer VFA[50]/Na-Acrylate=70 Mol %/30 Mol % from P2)

1224.3 g of the polymer solution obtained according to Example P-P2 are in a 2 L four-necked flask with a blade stirrer, internal thermometer, dropping funnel and reflux condenser at a stirrer speed of 80 rpm with 704.4 g of water and 8.9 g of a 40% wt. solution aqueous sodium bisulfite solution and then heated to 80° C. Then add 140.4 g of a 25% wt. sodium hydroxide solution. The mixture is kept at 80° C. for 5 hours. It is then cooled to room temperature and adjusted to pH 8.5 using 37% hydrochloric acid.

A slightly yellow, slightly cloudy and viscous solution with a polymer content of 7.1% wt. is obtained. The degree of hydrolysis of the vinylformamide units is 50 mol %.

Example H-H4P3: H4P3 (Copolymer VFA[100]/Na-Acrylate=70 Mol %/30 Mol % from P3)

600.0 g of the polymer solution obtained according to Example P-P3 are mixed in a 2 L four-necked flask with a blade stirrer, internal thermometer, dropping funnel and reflux condenser at a stirrer speed of 80 rpm with 4.5 g of a 40% wt. aqueous sodium bisulfite solution and then on heated to 80° C. Then 150.0 g of a 25% aqueous sodium hydroxide solution is added. The mixture is kept at 80° C. for 7 hours. The product obtained is cooled to room temperature and adjusted to pH 8.5 with 37% hydrochloric acid.

A slightly yellow, viscous solution with a polymer content of 7.7% wt. is obtained. The degree of hydrolysis of the vinylformamide units is 100 mol %.

Example H-H5P3: H5P3 (Copolymer VFA[51]/Na-Acrylate=70 Mol %/30 Mol % from P3)

600.0 g of the polymer solution obtained according to Example P-P3 are mixed in a 2 L four-necked flask with a blade stirrer, internal thermometer, dropping funnel and reflux condenser at a stirrer speed of 80 rpm with 4.5 g of a 40% wt. aqueous sodium bisulfite solution and then on heated to 80° C. Then 72.0 g of a 25% aqueous sodium hydroxide solution is added. The mixture is kept at 80° C. for 3.5 hours. The product obtained is cooled to room temperature and adjusted to pH 8.5 with 37% hydrochloric acid.

A slightly yellow, slightly cloudy and viscous solution with a polymer content of 10.4% wt. is obtained. The degree of hydrolysis of the vinylformamide units is 51 mol %.

Example H-H6P3: H6P3 (Copolymer VFA[30]/Na-Acrylate=70 Mol %/30 Mol % from P3)

600.0 g of the polymer solution obtained according to Example P-P3 are mixed in a 2 L four-necked flask with a blade stirrer, internal thermometer, dropping funnel and reflux condenser at a stirrer speed of 80 rpm with 4.5 g of a 40% wt. aqueous sodium bisulfite solution and then on heated to 80° C. Then 45.5 g of a 25% aqueous sodium hydroxide solution is added. The mixture is kept at 80° C. for 7 hours. The product obtained is cooled to room temperature and adjusted to pH 8.5 with 37% hydrochloric acid.

A slightly yellow, slightly cloudy and viscous solution with a polymer content of 11.7% wt. is obtained. The degree of hydrolysis of the vinylformamide units is 30 mol %.

Example H-H7P4: H7P4 (Copolymer VFA[51]/Na-Acrylate=70 Mol %/30 Mol % from P4)

159.8 g of the polymer solution obtained according to Example P-P4 are mixed in a 500 L four-necked flask with a blade stirrer, internal thermometer, dropping funnel and reflux condenser at a stirrer speed of 80 rpm with 0.7 g of a 40% wt. aqueous sodium bisulfite solution and then on heated to 80° C. Then 11.8 g of a 25% aqueous sodium hydroxide solution is added. The mixture is kept at 80° C. for 4.5 hours. The product obtained is diluted with 71.4 g of water and cooled to room temperature. A pH of 8.5 is then set with 4.7 g of 37% hydrochloric acid.

A slightly yellow, slightly cloudy and viscous solution with a polymer content of 5.0% wt. is obtained. The degree of hydrolysis of the vinylformamide units is 51 mol %.

Example H-H8P5: H8P5 (Copolymer VFA[100]/Na-Acrylate=60 Mol %/40 Mol % from P5)

1102.9 g of the polymer solution obtained according to Example P-P5 are mixed in a four-necked flask with a blade stirrer, internal thermometer, dropping funnel and reflux condenser at a stirrer speed of 80 rpm with 10.5 g of a 40% wt. aqueous sodium bisulfite solution and then on heated to 80° C. Then add 355.6 g of a 25% wt. sodium hydroxide solution. The mixture is kept at 80° C. for 7 hours and then cooled to room temperature and adjusted to pH 8.5 using 37% hydrochloric acid.

A slightly cloudy, viscous solution with a polymer content of 11.5% wt. is obtained. The degree of hydrolysis of the vinylformamide units is 100 mol %.

Example H-H9P6: H9P6 (Copolymer VFA[35]/Na-Acrylate=80 Mol %/20 Mol % from P6)

600.0 g of the polymer solution obtained according to Example P-P6 are mixed in a 2 L four-necked flask with a blade stirrer, internal thermometer, dropping funnel and reflux condenser at a stirrer speed of 80 rpm with 4.5 g of a 40% wt. aqueous sodium bisulfite solution and then on heated to 80° C. Then add 83.3 g of a 25% wt. sodium hydroxide solution. The mixture is kept at 80° C. for 3.5 hours. The product obtained is cooled to room temperature and adjusted to pH 8.5 with 37% hydrochloric acid.

A slightly yellow, slightly cloudy and viscous solution with a polymer content of 15.3% wt. is obtained. The degree of hydrolysis of the vinylformamide units is 35 mol %.

A-4) Overview of Individual Polymers Produced

TABLE TabA1

| Polymer | Unhydrolyzed N-CHO of the original N-vinylformamide [Mol %] a) | hydrolysed N-CHO of the original N-vinylformamide [mol %] b) | Sodium acrylate [Mol %] c) | Mw [Mio. Dalton] | Hydrolysis degree [mol %] |
|---|---|---|---|---|---|
| P1 | 100 | (0) | 0 | 0.34 | (0) |
| H1P1 | 68 | 32 | 0 | — | 32 |
| H2P1 | 0 | 100 | 0 | — | 100 |
| P2 | 70 | (0) | 30 | 2.2 | (0) |
| H3P2 | 35 | 35 | 30 | — | 50 |
| P3 | 70 | (0) | 30 | 0.8 | (0) |
| H4P3 | 0 | 70 | 30 | — | 100 |
| H5P3 | 35 | 35 | 30 | — | 51 |
| H6P3 | 49 | 21 | 30 | — | 30 |
| P4 | 70 | (0) | 30 | 4.1 | (0) |
| H7P4 | 35 | 35 | 30 | — | 51 |
| P5 | 60 | (0) | 40 | 0.9 | (0) |
| H8P5 | 0 | 60 | 40 | — | 100 |

TABLE TabA1-continued

| Polymer | Unhydrolyzed N-CHO of the original N-vinylformamide [Mol %] a) | hydrolysed N-CHO of the original N-vinylformamide [mol %] b) | Sodium acrylate [Mol %] c) | Mw [Mio. Dalton] | Hydrolysis degree [mol %] |
|---|---|---|---|---|---|
| P6 | 80 | (0) | 20 | 0.7 | (0) |
| H9P6 | 52 | 28 | 20 | 0.5 | 35 |

Footnotes:
a) Non-hydrolysed N-CHO groups of the N-vinylformamide used in the polymerization calculated based on the amount of N-vinylformamide used in the polymerization minus hydrolysed N-CHO groups of the N-vinylformamide used in the polymerization
b) hydrolysed N-CHO groups of the N-vinylformamide used in the polymerization, calculated based on the amount of N-vinylformamide used in the polymerization and determined degree of hydrolysis
c) Polymerized sodium acrylate calculated based on the amount of sodium acrylate used in the polymerization B) Preparation of suspensions or solutions for spraying To prepare the suspensions or solutions for spraying, the corresponding aqueous solutions from the examples containing the polymer mentioned and, if appropriate, the starch mentioned are added as a solid with stirring into a glass vessel with a 4-liter marking, in which there are already 2 litres of drinking water. For this purpose, in the case of the aqueous solutions from the examples containing the polymer mentioned, so much of this aqueous solution is added that 20 g or, in the case of the combination with starch, 10 g of polymer, based on the polymer content, are added. In the case of a combination with starch, 10 g of starch based on the solids content of the starch are added. After the addition is complete, the slurry is mixed or dissolved. Drinking water is then added until the 4-litre mark on the rim of the vessel is reached. The preparation of the pure starch suspension is described below. The reference solution without additives (=L (0) in table TabB1) consists only of drinking water. The compositions of the spray solutions L are given in Table TabB1 and those of the spray suspensions S in Table TabB2.

Example S-St1: St1 (Strength)

A starch suspension of the commercial starch Cargill*size 35802 (cationic starch, available from Cargill, powder insoluble/partially soluble in water) is prepared by slurring 20 g of the solid powder of this starch in 2 L drinking water at room temperature and further dilution with drinking water up to 4 L total volume. The starch concentration in the aqueous suspension is 5 g/L based on the solids content. The pH Value of the aqueous suspension is 7.3.

TABLE TabB1

| Spray solution L | contained additives | Concentration Polymer [g/L] c) |
|---|---|---|
| L0 (–) a) | — | 0 |
| L1 (P1) a) | P1 | 5 |
| L2 (H1P1) a) | H1P1 | 5 |
| L3 (H2P1) a) | H2P1 | 5 |
| L4 (H3P2) b) | H3P2 | 5 |
| L5 (H4P3) b) | H4P3 | 5 |
| L6 (H5P3) b) | H5P3 | 5 |
| L7 (H6P3) b) | H6P3 | 5 |
| L8 (P3) b) | P3 | 5 |
| L9 (H7P4) b) | H7P4 | 5 |
| L10 (H8P5) b) | H8P5 | 5 |
| L11 (H9P6) b) | H9P6 | 5 |

Footnotes:
a) comparative
b) inventively
c) Concentration based on the polymer content of the aqueous solution of the example TABLE TabB2

| Spray suspension S | contained additives | Concentration strength [g/L] | Concentration Polymer [g/L] c) |
|---|---|---|---|
| S1 (St1) a) | St1 | 5 | — |
| S2 (St1 + P1) a) | St1 + P1 | 2.5 | 2.5 |
| S3 (St1 + H1P1) a) | St1 + H1P1 | 2.5 | 2.5 |
| S4 (St1 + H2P1) a) | St1 + H2P1 | 2.5 | 2.5 |
| S5 (St1 + H3P2) b) | St1 + H3P2 | 2.5 | 2.5 |
| S6 (St1 + H4P3) b) | St1 + H4P3 | 2.5 | 2.5 |
| S7 (St1 + H5P3) b) | St1 + H5P3 | 2.5 | 2.5 |
| S8 (St1 + H6P3) b) | St1 + H6P3 | 2.5 | 2.5 |
| S9 (St1 + P3) b) | St1 + P3 | 2.5 | 2.5 |
| S10 (St1 + H7P4) b) | St1 + H7P4 | 2.5 | 2.5 |
| S11 (St1 + H8P5) b) | St1 + H8P5 | 2.5 | 2.5 |
| S12 (St1 + H9P6) b) | St1 + H9P6 | 2.5 | 2.5 |

Footnotes:
a) comparative
b) inventively
c) Concentration based on the polymer content of the aqueous solution of the example C) Paper C-1) Physical characterizations Dry Content Determination To determine the dry matter content (TG), the mass of the moist sample (MF) is determined from a moist paper sample on a calibrated top-pan high-speed scale that can be used to weigh to 0.01 g. The moist paper sample preferably has an area of at least 10 cm×10 cm. The moist paper sample is then placed in a calibrated drying cabinet, which can maintain a set temperature to a deviation of ±2° C., and dried to constant mass at a set temperature of 105° C. This is typically the case after 90 minutes. The still warm dried paper sample is then transferred to a desiccator which contains a suitable drying agent such as silica gel. After cooling at room temperature, the mass of the dried paper sample (MT) is determined on the scale. The dry content of the paper sample is calculated according to TG=100·MT/MF and is stated in % wt. The percentage is often given with a decimal place. If this percentage value does not change with the rounded first decimal place, this is an indication of the achievement of constant mass at dry contents of 1 to 100% wt. For dry contents from 0 to less than 1% wt., the rounded second decimal place of the percentage value is the corresponding indication. Drying is carried out at ambient pressure, possibly 101.32 KPa, which is carried out without a correction for a deviation resulting from weather and sea level. During the drying process, the atmospheric pressure normally prevailing in the environment is maintained, possibly at 101.32 kPa. A correction for a slightly different air pressure due to weather and sea level is not made. In the case of a moist sample that does not yet have a paper consistency, e.g. a pulp suspension or a paper pulp, the moist sample is dried in an appropriate dish with a large surface.

Internal Strength of an Obtained Dried Paper Sheet

A dried paper sheet obtained is examined after a storage period in the climatic room at a constant 23° C. and 50% humidity for 12 hours. The internal strength is carried out according to a procedure which corresponds to the Tappi regulation T833 pm-94. 10 paper strips with a width of 2.5 cm and a length of 12.7 cm are cut from two sheets of paper in A4 format, which are previously obtained from the dried paper web of the trial machine. Each individual paper sample is attached to a separate base plate and a metal bracket with double-sided adhesive tape. The metal angle is knocked out with a pendulum, whereby the paper sample to be examined is split in a plane parallel to the paper surface. The energy that is required for this process is measured. The device used for the measurement is an internal bond test station from TMI (Testing Machines Inc. Islandia, N.Y. USA). The double-sided adhesive tape is a product from 3M (width 25.4 mm, type Scotch No. 140). The measuring device supplies the energy required for the splitting, based on a standardized area in J/m2. The mean is formed from 10 individual measurements each.

C-2) Production of the Paper Raw Material

A paper pulp, which is produced by opening paper webs in a pulper, which serves as the raw material for paper making. The pulp is obtained by dissolving it in drinking water and by mechanically processing the paper webs in the pulper at approx. 3.5-4% wt. dry matter. The paper pulp typically has a degree of fineness around 50° Schopper Riegler. The paper webs are packaging base papers of the "Testliner 2" specification with a basis weight of 120 g/m2, which comes from Thurpapier in Weinfelden (Switzerland).

C-3) Production of the Papers with Spray Treatment of the Wet Paper Web

The papers produced consist of two layers: a top layer with a grammage of 40 g/m$^2$ and a base with a grammage of 80 g/m$^2$. This paper is produced on a test paper machine from the Paper Technology Foundation (PTS) in Heidenau. In order to make the two-layer system possible, the test machine is equipped with a headbox for the bottom wire and an additional headbox for the top wire.

The paper pulp is diluted to a dry content of 0.35% wt. with drinking water. The paper pulp is then pumped into the two headboxes and from there applied to the top sieve in the form of a sieve and the bottom sieve in the shape of a sieve. The sieve for the top layer and the sieve for the base run towards each other at an angle of 60° and form a narrow gap at the end. The top layer and the underlay come into contact and form enough adhesion to separate from the sieves deflected after the gap. Then the weakly adhering layers run into the press section and are compressed on the side facing away from the sieves in the press section of the machine, i.e. pressed together under drainage. The resulting paper web is then sent through the heated cylinders of the dryer section, in which temperature peaks can be reached up to 100° C., and the dried paper is rolled up at the end of the dryer section. The dry content of the dried paper obtained is typically 93-94% wt. for the previously described type of fabric, the stated grammage and a machine speed of 0.85 m$^2$ per minute. The contact pressures in the press section can be varied, which results in different dry contents after the press section. Depending on the contact pressure in the test paper machine, these are between 40% wt. and 52% wt. The dry content in front of the press can be varied by using a chemical dewatering agent and/or by applying a vacuum to the undersides of the top and bottom sieves. As a result, the dry contents in front of the press in the test paper machine can be varied in a range between 15% wt. and 22% wt.

Three settings are used:

1. In setting "B", which is the basic setting, the metered amount of retention aid (Percol 540, RTM BASF, cationically modified polyacrylamide, emulsified in hydrocarbons and water, density approx. 1 g/cm$^3$, pH-Value 3-6, cream-colored, solids content 44% wt.) is very low and is approximately 100 g of solids retention agent per tonne of paper for the entire fabric from the top and bottom layers (0.01% wt.). The same relative amount of the same retention agent is metered into the top and bottom layers. The dry content in front of the press is approx. 15.8% wt. under these conditions.

2. In the setting "V", in which a vacuum is used, the retention agent and the retention agent amount remain constant at 100 g per ton of paper as stated above in the setting according to point 1. However, an additional vacuum is created on the underside of the respective sieve after the two headboxes. The vacuum is set in such a way that the desired effects occur in a sufficient form without the formation being disturbed. This situation corresponds to a setting of the vacuum, which here leads to a dry content of the wet paper webs in front of the press of approximately 18.2% wt.

3. In the setting "R", where additional retention agent is used, the vacuum is switched off after the setting under point 2. The amount of the retention aid in the setting according to item 1 is increased to about 370 g of the retention aid retention content per ton of paper of the total substance (0.037% wt.). The dry content of the wet paper webs in front of the press reached about 18.2% wt. which is the value previously achieved with vacuum according to point 2.

For spray treatment of the wet paper web with spray solutions or spray suspensions, the spray solution or the spray suspension after the press ("aP"="after press") is sprayed onto a flat outside of the layers that have already been gummed together, here the outside is formed by the base, A two-fluid nozzle by the company Schlick is used for this. The position of the spray nozzle is approx. 20 cm in front of the line of contact of the paper web with the first cylinder of the dryer section. The pressure to open the nozzle valve and atomize the spray solution or spray suspension is 1 bar. The spray width with even coverage is 35 cm. Nevertheless, when processing the dried paper sheets for later analysis, 5 cm at the edge are not considered. The spray solution or spray suspension is sprayed with two different application quantities. The first quantity is in a range around 0.1 L/m$^2$, this corresponds to an application quantity of 0.5 g/m$^2$ at an approximate concentration of 5 g/L. The second quantity is in a range around 0.2 L/m$^2$, this corresponds to an application quantity of 1.0 g/m$^2$ at an approximate concentration of 5 g/L. Due to the high dilution, the density of the spray solution or spray suspension can be assumed to be approximately 1 g/cm$^3$.

C-4) Experiments and Measurement of the Dried Papers Obtained

Dried papers are produced on the paper machine as described in C-3) considering the respective information in Tables TabC1-Tab C4 for the concentration of the spray solution or spray dispersion and the machine setting. Tables TabC1 to TabC4 also give the measured internal strengths of dried paper test sheets as described in C-1).

TABLE TabC1

| "aP"-0.1 L/m² | | Internal strength [J/m²] | | |
|---|---|---|---|---|
| Example No. | Spray solution | Setting "B" | Setting "V" | Setting "R" |
| R1 | L0 (–) [a] | 147 | 139 | 142 |
| C1-1 | L1 (P1) [a] | 163 | 156 | 168 |
| C1-2 | L2 (H1P1) [a] | 162 | 157 | 159 |
| C1-3 | L3 (H2P1) [a] | 165 | 156 | 161 |
| C1-4 | L4 (H3P2) [b] | 292 | 346 | 338 |
| C1-5 | L5 (H4P3) [b] | 263 | 331 | 335 |
| C1-6 | L6 (H5P3) [b] | 265 | 314 | 322 |
| C1-7 | L7 (H6P3) [b] | 265 | 313 | 321 |
| C1-8 | L8 (P3) [b] | 282 | 335 | 329 |
| C1-9 | L9 (H7P4) [b] | 266 | 318 | 312 |
| C1-10 | L10 (H8P5) [b] | 266 | 313 | 316 |
| C1-11 | L11 (H9P6) [b] | 263 | 314 | 317 |

Footnotes:
[a] comparative
[b] inventively

In comparison with the comparative examples, Table TabC1 illustrates that the papers produced with spray solutions according to the invention have a significantly improved internal strength. Furthermore, the increase in the dry content after the sieve section using vacuum or an increased amount of retention polymer in the papers produced with the spray solutions according to the invention leads to a further improvement in the internal strength, while these measures have little and inconsistent effects in the comparative examples.

TABLE TabC2

| "aP"-0.2 L/m² | | Internal strength [J/m²] | | |
|---|---|---|---|---|
| Example No. | Spray solution | Setting "B" | Setting "V" | Setting "R" |
| R2 | L0 (–) [a] | 149 | 158 | 156 |
| C2-1 | L1 (P1) [a] | 174 | 167 | 173 |
| C2-2 | L2 (H1P1) [a] | 171 | 165 | 173 |
| C2-3 | L3 (H2P1) [a] | 173 | 163 | 172 |
| C2-4 | L4 (H3P2) [b] | 312 | 383 | 371 |
| C2-5 | L5 (H4P3) [b] | 281 | 351 | 363 |
| C2-6 | L6 (H5P3) [b] | 279 | 339 | 345 |
| C2-7 | L7 (H6P3) [b] | 277 | 338 | 340 |
| C2-8 | L8 (P3) [b] | 303 | 349 | 353 |
| C2-9 | L9 (H7P4) [b] | 296 | 348 | 342 |
| C2-10 | L10 (H8P5) [b] | 285 | 334 | 342 |
| C2-11 | L11 (H9P6) [b] | 289 | 341 | 338 |

Footnotes:
[a] comparative
[b] inventively

The table TabC2 illustrates that even when the application quantity is doubled, the papers produced with the spray solutions according to the invention have a significantly improved internal strength compared to the comparative examples. The increase in the dry content after the sieve section using vacuum or an increased amount of retention polymer in the papers produced with the spray solutions according to the invention leads to a further improvement in the internal strength, while these measures have little and inconsistent effects in the comparative examples.

TABLE TabC3

| "aP"-0.1 L/m² | | Internal strength [J/m²] | | |
|---|---|---|---|---|
| Example No. | Spray solution or spray suspension | Setting "B" | Setting "V" | Setting "R" |
| R1 | L0 (–) [a] | 147 | 139 | 142 |
| C3-1 | S1 (St1) [a] | 153 | 161 | 151 |
| C3-2 | S2 (St1 + P1) [a] | 154 | 153 | 171 |
| C3-3 | S3 (St1 + H1P1) [a] | 162 | 168 | 171 |
| C3-4 | S4 (St1 + H2P1) [a] | 155 | 148 | 162 |
| C3-5 | S5 (St1 + H3P2) [b] | 187 | 222 | 219 |
| C3-6 | S6 (St1 + H4P3) [b] | 191 | 219 | 225 |
| C3-7 | S7 (St1 + H5P3) [b] | 206 | 223 | 229 |
| C3-8 | S8 (St1 + H6P3) [b] | 195 | 231 | 219 |
| C3-9 | S9 (St1 + P3) [b] | 199 | 227 | 221 |
| C3-10 | S10 (St1 + H7P4) [b] | 197 | 238 | 241 |
| C3-11 | S11 (St1 + H8P5) [b] | 200 | 226 | 223 |
| C3-12 | S12 (St1 + H9P6) [b] | 197 | 217 | 223 |

Footnotes:
[a] comparative
[b] inventively

In table TabC3, as in table TabC1 and table TabC2, the papers produced with spray dispersions according to the invention have a significantly improved internal strength compared to the comparative examples. The increase in the dry content as per the sieve section using vacuum or an increased amount of retention polymer in the papers produced with the spray suspensions according to the invention leads to a further improvement in the internal strength, while these measures have little and inconsistent effects in the comparative examples. In comparison with Table TabC1, Table TabC3 shows that replacing half of the number of polymers used with cationic starch no longer leads to an improvement in the internal strength of the paper of the same size.

TABLE TabC4

| "aP"-0.2 L/m² | | Internal strength [J/m²] | | |
|---|---|---|---|---|
| Example No. | Spray solution or spray suspension | Setting "B" | Setting "V" | Setting "R" |
| R2 | L0 (–) [a] | 149 | 158 | 156 |
| C4-1 | S1 (St1) [a] | 159 | 167 | 164 |
| C4-2 | S2 (St1 + P1) [a] | 161 | 172 | 164 |
| C4-3 | S3 (St1 + H1P1) [a] | 174 | 168 | 171 |
| C4-4 | S4 (St1 + H2P1) [a] | 162 | 172 | 174 |
| C4-5 | S5 (St1 + H3P2) [b] | 205 | 235 | 241 |
| C4-6 | S6 (St1 + H4P3) [b] | 199 | 231 | 227 |
| C4-7 | S7 (St1 + H5P3) [b] | 214 | 236 | 238 |
| C4-8 | S8 (St1 + H6P3) [b] | 207 | 225 | 228 |
| C4-9 | S9 (St1 + P3) [b] | 209 | 238 | 229 |
| C4-10 | S10 (St1 + H7P4) [b] | 211 | 246 | 249 |
| C4-11 | S11 (St1 + H8P5) [b] | 212 | 234 | 229 |
| C4-12 | S12 (St1 + H9P6) [b] | 208 | 231 | 239 |

Footnotes:
[a] comparative
[b] inventively

The table TabC4 illustrates that even when the application quantity is doubled, the papers produced with the spray suspensions according to the invention have a significantly improved internal strength compared to the comparative examples. The increase in the dry content as per the sieve section using vacuum or an increased amount of retention polymer in the papers produced with the spray suspensions according to the invention leads to a further improvement in the internal strength, while these measures have little and inconsistent effects in the comparative examples. In comparison with Table TabC2, Table TabC4 shows that replacing half of the number of polymers used with cationic starch no longer leads to an improvement in the internal strength of the paper of the same size.

The invention claimed is:

1. A process to produce dried single-layer or multi-layer paper, comprising the steps for a single-layer paper of:

(A) dehydrating a first aqueous fibre suspension, which has a dry matter content between 0.1 wt. % and 6 wt. %, on a first sieve, whereby a first fibrous web, which has a dry matter content between 14 wt. % and 25 wt. %, arises, (D-1) dehydrating the first fibrous web by pressing, thereby creating a partially dehydrated first fibrous web, (E-1) spraying the partially dehydrated first fibrous web on at least one surface side with a spray solution or spray suspension, which results in a sprayed partially dehydrated first fibrous web, (F-1) dehydrating the sprayed partially dehydrated first fibrous web by applying heat to form the dried single-layer paper;

or comprising the steps for a multi-layer paper of:

(A) dehydrating a first aqueous fibre suspension, which has a dry matter content between 0.1 wt. % and 6 wt. %, on a first sieve, whereby a first fibrous web, which has a dry matter content between 14 wt. % and 25 wt. %, arises, (B) dehydrating a second aqueous fibre suspension, which has a dry matter content between 0.1 wt. % and 6 wt. %, on a second sieve, whereby a second fibrous web, which has a dry matter content between 14 wt. % and 25 wt. %, arises, (C) assembling the first fibrous web to the second fibrous web such that the two fibrous webs touch each other on an entire surface side, thereby resulting in a layer compound, (D-2) dehydrating the layer compound by pressing, whereby a partially dehydrated layer compound is formed, (E-2) spraying the partially dehydrated layer compound on at least one surface side with a spray solution or spray suspension, whereby a sprayed layer compound is formed, (F-2) dehydrating the sprayed layer compound by applying heat results in the dried multi-layer paper;

wherein the spray solution or spray suspension comprises (e-a) water, and (e-b) at least one water-soluble polymer P, obtained by polymerizing (i) 40 to 85 mol % of a monomer of Formula I

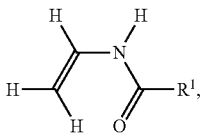

(I)

in which $R^1$=H or $C_1$-$C_6$-Alkyl, (ii) 15 to 60 mol % of one or more ethylenically unsaturated monomers which are different from a monomer of the Formula I, wherein the total amount of all monomers (i) and (ii) is 100 mol %, and optionally by subsequent partial or complete hydrolysis of the units of the monomers of the formula (I) polymerized into the polymer P to form primary amino or amidine groups, wherein the proportion of water is at least 75% wt., based on the spray solution or the spray suspension.

2. The process of claim 1 for the manufacture of dried multi-layer paper comprising the steps (A) dehydrating a first aqueous fibre suspension, which has a dry matter content between 0.1 wt. % and 6 wt. %, on a first sieve, whereby a first fibrous web, which has a dry matter content between 14 wt. % and 25 wt. %, arises, (B) dehydrating a second aqueous fibre suspension, which has a dry matter content between 0.1 wt. % and 6 wt. %, on a second sieve, whereby a second fibrous web, which has a dry matter content between 14 wt. % and 25 wt. %, arises, (C) assembling the first fibrous web to the second fibrous web such that the two fibrous webs touch each other on an entire surface side, thereby resulting in a layer compound, (D-2) dehydrating the layer compound by pressing, whereby a partially dehydrated layer compound is formed, (E-2) spraying the partially dehydrated layer compound on at least one surface side with a spray solution or spray suspension, whereby a sprayed layer compound is formed, (F-2) dehydrating the sprayed layer compound by applying heat to form the dried multi-layer paper.

3. The process of claim 1, wherein the spray solution or spray suspension has a pH value of 5.5 or greater.

4. The process of claim 1, wherein for the single-layer paper in step (D-1) the partially dewatered first fibrous web has a dry matter content between 35% wt. and 65% wt., and for the multi-layer paper in step (D-2) the partially dewatered layered compound has a dry content between 35% wt. and 65% wt.

5. The process of claim 1, wherein for the single-layer paper in step (F-1) the dried single-layer paper has a dry matter content of at least 88% wt., and for the multi-layer paper in step (F-2) this dried multi-layer paper has a dry content of at least 88% wt.

6. The process of claim 1, wherein the polymer P is formed by polymerizing (i) 40 to 85 mol % of a monomer of Formula I, (ii) 15 to 60 mol % of one or more ethylenically unsaturated monomers which are different from a monomer of the Formula I, wherein the one or more ethylenically unsaturated monomers are selected from (ii-1) acrylic acid or methacrylic acid or their alkali metal, alkaline earth metal or ammonium salts, (ii-2) acrylonitrile or methacrylonitrile, (ii-3) vinyl acetate, (ii-4) a monoethylenically unsaturated sulfonic acid, a monoethylenically unsaturated phosphonic acid, a monoethylenically unsaturated mono- or diester of phosphoric acid or a monoethylenically unsaturated carboxylic acid with 4 to 8 carbon atoms, which is different from methacrylic acid, or their alkali metal, alkaline earth metal or ammonium salts, (ii-5) a quaternized, monoethylenically unsaturated monomer, a monoethylenically unsaturated monomer which carries at least one secondary or tertiary amino group and whose at least one secondary or tertiary amino group is protonated at pH 7, or a diallyl-substituted amine which has exactly two ethylenic double bonds and is quaternized or at pH 7 is protonated, or its salt form, (ii-6) a monoethylenically unsaturated monomer which carries no charge at pH 7 and which is different from acrylonitrile, methacrylonitrile and vinyl acetate, or an ethylenically unsaturated monomer whose exactly two ethylenic double bonds are conjugated and which carries no charge at pH 7, (ii-7) 0 to 2 mol % a monomer which has at least two ethylenically unsaturated double bonds which are not conjugated, and which is different from a diallyl-substituted amine which has exactly two ethylenic double bonds, (ii-8) 0 to 10 mol % of ethylenically unsaturated monomer which is different than monomers (ii-1) to (ii-7), wherein the total amount of all monomers (i) and (ii-1) to (ii-8) is 100 mol % and mol % relates to the total amount of all monomers (i) and (ii-1) to (ii-8), and optionally by a subsequent partial or complete hydrolysis of the units of the monomers of the formula (I) polymerized into the polymer P to form primary amino groups or amidine groups, where in the presence of polymerized units of vinyl acetate these also partially or completely hydrolyse.

7. The process of claim 1, wherein in the polymerization (i) 50 to 85 mol % of a monomer of Formula I, (ii) 15 to 50 mol % of one or more ethylenically unsaturated monomers which are different from a monomer of the Formula I, are used.

8. The process of claim 1, wherein the one or more ethylenically unsaturated monomers comprises (ii-1) 15 to 50 mol % Acrylic acid or methacrylic acid or their alkali metal, alkaline earth metal or ammonium salts, where mol % refers to the total number of all monomers used in the polymerization and the total number of all monomers is 100 mol %.

9. The process of claim 1, wherein the polymer P is formed by polymerizing 50 to 85 mol % of a monomer of Formula I (ii-1) 15 to 50 mol % acrylic acid or methacrylic acid or their alkali metal, alkaline earth metal or ammonium salts, (ii-2) 0 to 35 mol % acrylonitrile or methacrylonitrile, wherein the total amount of all monomers (i) and (ii-1) to (ii-2) is 100 mol % and mol % relates to the total amount of all monomers (i) and (ii-1) to (ii-2), and optionally by subsequent partial or complete hydrolysis of the units of the monomers of the formula (I) polymerized into the polymer P to form primary amino groups or amidine groups.

10. The process of claim 1, wherein the single-layer paper in step (A) is dewatered to a dry content of 17% to 22% wt., and for the multi-layer paper in steps (A) and (B) each is dewatered to a dry content of 17% to 22% wt.

11. The process of claim 1, wherein an organic polymer (a-c) is added as a retention agent for the single-layer paper of the first aqueous fibre suspension comprising (a-a) water and (a-b) first fibre before dewatering in step (A), and for the multi-layer paper of the first aqueous fibre suspension, comprising (a-a) water and (a-b) first fibre, an organic polymer (a-c) is added as a retention agent before dewatering in step (A), and the second aqueous fibre suspension, comprising (b-a) water and (b-b) second fibre, before dewatering in step (B) an organic polymer (b-c) is added as a retention agent.

12. The process of claim 11, wherein for the single-layer paper the amount of added organic polymer (a-c) is 0.001% wt. to 0.2% wt. based on the first fibre (a-b), and for the multi-layer paper, the amount of organic polymer (a-c) added is 0.001% wt. to 0.2% wt., based on the first fibre material (a-b), and the amount of organic polymer (b-c) added is 0.001% wt. to 0.2 wt. % based on the second fibre (b-b).

13. The process of claim 1, wherein for the single-layer paper the first sieve is a fourdrinier, for multi-layer paper the first sieve is a fourdrinier and the second sieve is a fourdrinier.

14. The process of claim 1, wherein for the single-layer paper in step (A) the first fibrous suspension is applied to the first sieve with a first sieve top side and a first sieve underside on the first sieve top, and the dewatering by applying a vacuum to the first underside of the sieve is supported, and for the multi-layer paper in step (A) the first fibrous suspension is applied to the first sieve with a first top side of the sieve and a first underside of the sieve on the first top side of the sieve, and the dewatering is supported by applying a vacuum to the first underside of the sieve, in step (B), the second fibrous suspension is applied to the second sieve with a second sieve top side and a second sieve bottom on the second sieve top, and dewatering is supported by applying a vacuum to the second sieve bottom, or in step (A) first fibrous suspension and in step (B) the second fibrous suspension is applied to the corresponding first sieve top side and second sieve top side, and the respective dewatering is supported by applying a vacuum to the corresponding first sieve bottom and second sieve bottom.

15. The process of claim 1, wherein for the single-layer paper, the process is carried out in a paper machine, the equipment of which is equipped with a first sieve section with the first sieve, which has a first sieve top side and a first sieve underside, a press section, a spray device containing the spray solution or spray suspension and a dryer section with heated cylinders, and in the paper machine this in the order of the first sieve section, followed by the press section, followed by the spray device and then the dryer section are arranged, and for the multi-layer paper the process is carried out in a paper machine, the equipment of which has a first sieve section with the first sieve, which has a first sieve top side and a first sieve bottom, a second sieve section with the second sieve, which has a second sieve top side and a second sieve bottom, a press section, a spray device containing the spray solution or spray suspensions and a dryer section with heated cylinders, and these are arranged in the paper machine in the order of the first sieve section and second sieve section, followed by the press section, followed by the spray device and then the dryer section.

16. The process of claim 1, wherein for the single-layer paper in step (E-1) the spray solution or spray suspension for spraying is placed under an overpressure of 0.5 to 4.5 bar compared to the ambient pressure, and for that multi-layer paper in step (E-2) the spray solution or spray suspension for spraying is placed under an overpressure of 0.5 to 4.5 bar relative to the ambient pressure.

17. The process of claim 1, wherein the dry content is determined by drying at 105° C. to constant mass.

18. A dried single-layer paper formed by the process of claim 1.

19. A dried multi-layer paper formed by the process of claim 1.

* * * * *